US011383889B2

(12) United States Patent
Fang

(10) Patent No.: US 11,383,889 B2
(45) Date of Patent: Jul. 12, 2022

(54) SQUEEZER AND LIQUID DISCHARGE SYSTEM AND METHOD

(71) Applicant: SHANGHAI HONGYAN RETURNABLE TRANSIT PACKAGINGS CO., LTD, Shanghai (CN)

(72) Inventor: Zhengwei Fang, Shanghai (CN)

(73) Assignee: SHANGHAI HONGYAN RETURNABLE TRANSIT PACKAGINGS CO., LTD, Shanghai (CN)

( * ) Notice: Subject to any disclaimer, the term of this patent is extended or adjusted under 35 U.S.C. 154(b) by 0 days.

(21) Appl. No.: 16/324,383

(22) PCT Filed: Jul. 31, 2017

(86) PCT No.: PCT/CN2017/095157
§ 371 (c)(1),
(2) Date: Feb. 8, 2019

(87) PCT Pub. No.: WO2018/028451
PCT Pub. Date: Feb. 15, 2018

(65) Prior Publication Data

US 2019/0217995 A1 Jul. 18, 2019

(30) Foreign Application Priority Data

Aug. 8, 2016 (CN) ..... 201610642487.2
Aug. 8, 2016 (CN) ..... 201610642731.5
Nov. 14, 2016 (CN) ..... 201611032567.2

(51) Int. Cl.
*B65D 33/01* (2006.01)
*B65D 35/28* (2006.01)
(Continued)

(52) U.S. Cl.
CPC ..... *B65D 33/01* (2013.01); *B65D 35/285* (2013.01); *B65D 77/065* (2013.01); *B65D 85/72* (2013.01);
(Continued)

(58) Field of Classification Search
CPC .... B65D 33/01; B65D 35/285; B65D 77/065; B65D 85/72; B65D 5/56; B65D 90/046;
(Continued)

(56) References Cited

U.S. PATENT DOCUMENTS 1,728,147 A * 9/1929 Winsor ..... B65D 35/285 222/102
3,151,616 A * 10/1964 Selfon ..... A61M 5/148 604/131
(Continued)

FOREIGN PATENT DOCUMENTS

CN 1857970 A 11/2006
CN 103075564 A 5/2013
(Continued)

OTHER PUBLICATIONS

Examination Report issued in Australian Application No. 2017309920, dated Feb. 9, 2021.
(Continued)

*Primary Examiner* — Vishal Pancholi
*Assistant Examiner* — Robert K Nichols, II
(74) *Attorney, Agent, or Firm* — Hamre, Schumann, Mueller & Larson, P.C.

(57) ABSTRACT

A squeezer and fluid discharge system and method are disclosed. The fluid discharge system includes a container, a liner bag, a squeezing device and a driving device, the liner bag is installed in the container, and the driving device is connected to the squeezing device and used to drive the squeezing device. The squeezing device comprises at least
(Continued)

two rollers, and the liner bag is formed by welding a front panel and a rear panel and is provided with a discharge port which is arranged adjacent to the weld line at the bottom of the liner bag.

9 Claims, 40 Drawing Sheets

(51) Int. Cl.

| | |
|---|---|
| ***B65D 77/06*** | (2006.01) |
| ***B65D 85/72*** | (2006.01) |
| ***B67D 7/00*** | (2010.01) |
| *B65D 5/56* | (2006.01) |
| *B65D 90/04* | (2006.01) |
| *B67D 7/02* | (2010.01) |

(52) U.S. Cl.
CPC ..... *B67D 7/00* (2013.01); *B65D 5/56* (2013.01); *B65D 90/046* (2013.01); *B65D 2590/046* (2013.01); *B67D 7/0216* (2013.01)

(58) Field of Classification Search
CPC .. B65D 2590/046; B65D 88/54; B65D 35/24; B65D 35/28; B65D 88/546; B67D 7/00; B67D 7/0216; B30B 9/20; B65B 69/0091
USPC ..... 222/105, 102, 107, 181.1
See application file for complete search history.

(56) References Cited

U.S. PATENT DOCUMENTS

| | | | | |
|---|---|---|---|---|
| 3,289,893 | A | 12/1966 | Vance et al. | |
| 3,581,943 | A * | 6/1971 | Koenigshof | B05C 17/005 222/102 |
| 4,337,879 | A * | 7/1982 | Park | B65D 35/285 222/102 |
| 4,627,551 | A | 12/1986 | Kopp | |
| 5,490,613 | A | 2/1996 | Taylor et al. | |
| 5,615,791 | A | 4/1997 | Vatelot et al. | |
| 5,657,903 | A | 8/1997 | Roberts | |
| 5,758,789 | A | 6/1998 | Shin et al. | |
| 5,765,723 | A | 6/1998 | Wilcox | |
| 6,186,362 | B1 | 2/2001 | Smith | |
| 6,966,457 | B1 | 11/2005 | Torbet | |
| 7,798,365 | B2 * | 9/2010 | Baker | B65B 69/0091 222/100 |
| 2001/0050290 | A1 * | 12/2001 | Sampson | B65D 35/28 222/102 |
| 2009/0302057 | A1 * | 12/2009 | Matzel | A47K 5/1215 222/102 |
| 2011/0095046 | A1 | 4/2011 | Baker | |
| 2013/0092706 | A1 | 4/2013 | Ross | |
| 2014/0217118 | A1 | 8/2014 | Kuismanen | |
| 2015/0284181 | A1 | 10/2015 | Sullinger et al. | |
| 2017/0096293 | A1 * | 4/2017 | Sullinger | B30B 9/20 |

FOREIGN PATENT DOCUMENTS

| | | | |
|---|---|---|---|
| CN | 103889848 | A | 6/2014 |
| CN | 104097853 | A | 10/2014 |
| DE | 2520330 | A1 | 11/1976 |
| DE | 2748838 | A1 | 5/1979 |
| DE | 19913010 | A1 | 9/2000 |
| EP | 0194871 | A2 | 9/1986 |
| GB | 2119742 | A | 11/1983 |
| GB | 2168314 | A | 6/1986 |
| GB | 2340812 | A | 3/2000 |
| GB | 2475863 | A | 6/2011 |
| IL | 156984 | B | 5/2010 |
| JP | S50-102740 | U | 8/1975 |
| JP | S51159652 | U | 12/1976 |
| JP | 3002156 | U | 9/1994 |
| JP | H0826306 | A | 1/1996 |
| JP | H10198015 | A | 7/1998 |
| JP | 2007290729 | A | 11/2007 |
| JP | 2014525375 | A | 9/2014 |
| WO | 9015774 | A1 | 12/1990 |
| WO | 2004043814 | A1 | 5/2004 |
| WO | 2011080402 | A1 | 7/2011 |
| WO | 2015192789 | A1 | 12/2015 |

OTHER PUBLICATIONS

International Search Report (English and Chinese) and Written Opinion issued in PCT/CN2017/095157, dated Nov. 1, 2017; 11 pages provided.
The extended European Search Report issued in European Patent Application No. 17838581, dated Feb. 26, 2020.
Examinaton Report issued in Australian application No. 2017309920, dated Mar. 30, 2020.

* cited by examiner

SQUEEZER AND LIQUID DISCHARGE SYSTEM AND METHOD

CROSS REFERENCE TO RELATED APPLICATIONS

This application claims the priorities of Chinese patent application 2016106424872, entitled "liquid discharge system and liquid discharge method" filed on Aug. 8, 2016; Chinese patent application 2016106427315, entitled "liquid discharge system and liquid discharge method" filed on Nov. 14, 2016; and Chinese patent application 201611032567.2, entitled "squeezer and liquid discharge system and method" filed on Nov. 14, 2016, the entire disclosures thereof are incorporated herein by reference.

TECHNICAL FIELD

This invention relates to logistics transportation field, and in particular a liquid discharge system and liquid discharge method.

TECHNICAL BACKGROUND

There are many liquid storage device in the market for storage, transportation, filling, discharging and the like of viscous liquid.

U.S. Pat. No. 5,765,723A disclosed a sealed liquid bag, the body thereof is a sealed soft container made by hot-melting welding or high-frequency welding PVC plastic-coated cloth; the sealed soft container is provided with an inlet valve and an outlet valve at two ends thereof. This liquid liner bag body is effective when using in the high speed low viscous liquid; however, during viscous liquid discharging, the discharge is inefficient; there are much liquid residues in the bag after discharging, rendering waste of liquid. Generally, at the end of discharging, the liner bag is twisted by spirally twisting and squeezing the body thereof to squeeze the liquid residues out.

IL156984A disclosed a sealed liquid bag, the body thereof is a sealed soft container made by hot-melting welding or high-frequency welding PVC plastic-coated cloth or PE film; the sealed soft container is provided with an inlet valve and an outlet valve at two ends thereof; the body also includes a gas bag for assisting in discharging, with an gas charging port on the gas bag. During liquid discharging, the assisted gas bag need to be charged with gas, the viscous liquid is discharged by the squeezing of the gas. This solution can not solve the problem of liquid residues completely, and assisted gas charging is needed, rendering the increase of cost.

US2015284181A1 disclosed a sealed liquid bag, the body thereof is a sealed soft container made by hot-melting welding or high-frequency welding PVC plastic-coated cloth or PE film; when viscous liquid discharging, the intermediate bulk container for transporting liquid is tilted by mechanical structure so that the discharging outlet is located at the lowest position. Such an operation is time consuming, inefficient, and inconvenient, further there are much liquid residues in the liner bag after discharging, rendering waste of liquid.

SUMMARY

This invention aims to provide a liquid discharge system which has simple structure, small footprint, low cost, is convenient to operate, and has few liquid residues.

In order to achieve the above aim, according to one aspect of this invention, there provides an squeezer, which includes a pair of squeezing members, wherein one of the pair of squeezing members is arranged to be movable relative to the other squeezing member, and the pair of squeezing members are configured to be capable of operatively clamping an object to be clamped therebetween, and applying a squeezing force to the clamped object while the squeezing member and the clamped object are relatively moving.

Preferably, the pair of squeezing members are further configured to apply a preclamping force to the clamped object when the clamped object is clamped to the squeezer.

Preferably, the outermost material of at least one squeezing member of the pair of squeezing members is elastic soft material.

Preferably, the clamped object is a liner bag containing liquid, and the pair of squeezing members are arranged to be able to descend as the liquid in the liner bag decreases.

According to another aspect of this invention, there provides an squeezer, which includes a pair of squeezing members and a driving device, wherein the pair of squeezing members are configured to operatively clamp an object to be clamped therebetween and when the squeezing members and the clamped object are relatively moving, the pair of squeezing members apply a squeezing force to the clamped object, and the driving device is associated with the pair of squeezing members and is at least capable of driving one of the pair of squeezing members to move relative to the other, or the driving device is associated with the clamped object and enable the clamped object move relative to the pair of squeezing members.

Preferably, the squeezing member is rolling shaft, plate or the combination thereof.

Preferably, the pair of squeezing members are a pair of rolling shafts, and the pair of rolling shafts can be rotated in opposite directions and provided with a rolling shaft squeezing segment and a rolling shaft locking portion which is used to operatively lock or loose the pair of rolling shafts, and the pair of rolling shafts are arranged to operatively clamp the liner bag between the rolling shaft squeezing segments, wherein after the liner bag is located between the rolling shaft squeezing segments of the pair of rolling shafts and the pair of rolling shafts are locked by the rolling shaft locking portions, the opposite rotation of the rolling shaft squeezing segments of the pair of rolling shafts will apply a squeezing force to the liner bag.

Preferably, the clamped object is a liner bag containing a viscous liquid, and the pair of rolling shafts are arranged to be able to descend as the liquid in the clamped object decreases while rotating in opposite directions.

According to another aspect of this invention, there provides an squeezer which includes a pair of rolling shafts, and the pair of rolling shafts can be rotate in opposite directions and provided with a rolling shaft squeezing segment and a rolling shaft locking portion which is used to operatively lock or loose the pair of rolling shafts, and the pair of rolling shafts are configured to operatively clamp the object to be clamped between the rolling shaft squeezing segments and apply a squeezing force to the liner bag after the liner bag is located between the rolling shaft squeezing segments of the pair of rolling shafts and the pair of rolling shafts are locked by the rolling shaft locking portions, the opposite rotation of the rolling shaft squeezing segments of the pair of rolling shafts will apply a squeezing force to the clamped object.

Preferably, the clamped object is a liner bag containing liquid, and the pair of rolling shafts are arranged to be able to descend as the liquid in the clamped object decreases while rotating in opposite directions.

Preferably, the squeezer further includes a driving device, wherein the driving device is associated with the pair of rolling shafts and arranged to drive the pair of rolling shafts to rotate in opposite directions, or the driving device is associated with the clamped object and arranged to drive the clamped object to move relative to the pair of rolling shafts.

Preferably, the cross-section of the rolling shaft is round or oval.

Preferably, the driving device is pneumatic, electric or manual.

Preferably, the rolling shaft includes an elastic soft body and a supporting rod, and the elastic soft body is disposed around the supporting rod.

Preferably, each of the rolling shafts includes a supporting rod and an elastic soft body, the elastic soft body is disposed around the supporting rod, and an outer diameter of at least one portion of the elastic soft body uniformly varies in the axial direction to form a tapered elastic soft body.

According to another aspect of this invention, there also provides an squeezer for an intermediate bulk container, wherein the intermediate bulk container is installed with a liner bag which is provided with a discharge port, the squeezer includes a pair of squeezing members, wherein one of the pair of squeezing members is arranged to be movable relative to the other, and the pair of squeezing members are configured to operatively clamp the liner bag therebetween and applying a squeezing force to the liner bag while the squeezing members and the liner bag are relatively moving.

Preferably, the pair of squeezing members are further configured to apply a preclamping force to the liner bag when the liner bag is clamped to the squeezer.

Preferably, the outermost material of at least one squeezing member of the pair of squeezing members is elastic soft material.

According to another aspect of this invention, there also provides an squeezer for an intermediate bulk container, wherein the intermediate bulk container is installed with a liner bag—which is used to contain liquid and has a discharge port, the squeezer includes a pair of squeezing members, wherein one of the pair of squeezing members is arranged to be movable relative to the other, and the pair of squeezing members are configured to operatively clamp the liner bag therebetween, and apply a squeezing force to the liner bag while the squeezing members and the liner bag are relatively moving, and the pair of squeezing members are arranged to be able to descend as the liquid level in the liner bag decreases.

Preferably, the pair of squeezing members are further configured to apply a preclamping force to the liner bag when the liner bag is clamped to the squeezer.

Preferably, the outermost material of at least one squeezing member of the pair of squeezing members is elastic soft material.

Preferably, the liner bag is a liner bag containing viscous liquid.

According to another aspect of this invention, there also provides an squeezer for an intermediate bulk container, wherein the intermediate bulk container is installed with a liner bag which is used to contain liquid and has a discharge port, the squeezer includes a pair of squeezing members and a driving device, wherein the pair of squeezing members are configured to operatively clamp a liner bag therebetween, and apply a squeezing force to the liner bag while the squeezing member and the liner bag are relatively moving; and the driving device is associated with the pair of squeezing members and capable of driving one of the pair of squeezing members to move relative to the other, or the driving device is associated with the liner bag and enable the liner bag move relative to the pair of squeezing members.

Preferably, the pair of squeezing members are a pair of rolling shafts, and the pair of rolling shafts can be rotated in opposite directions and provided with a rolling shaft squeezing segment and a rolling shaft locking portion, which is used to operatively lock or loose the pair of rolling shafts, and the pair of rolling shafts are arranged to operatively clamp the liner bag between the rolling shaft squeezing segments, wherein after the liner bag is located between the rolling shaft squeezing segments of the pair of rolling shafts and the pair of rolling shafts are locked by the rolling shaft locking portions, the opposite rotation of the rolling shaft squeezing segments of the pair of rolling shafts will apply a squeezing force to the liner bag.

Preferably, the liner bag is a liner bag containing viscous liquid, and the pair of rolling shafts are arranged to be able to descend as the liquid in the liner bag decreases while rotating in opposite directions.

Preferably, the rolling shaft includes an elastic soft body and a supporting rod, and the elastic soft body is disposed around the supporting rod.

Preferably, each of the rolling shafts includes a supporting rod and an elastic soft body, the elastic soft body is disposed around the supporting rod, and an outer diameter of at least one portion of the elastic soft body uniformly varies in the axial direction to form a tapered elastic soft body.

According to another aspect of this invention, there also provides a fluid discharge system comprising a container and a liner bag which is installed in the container and provided with a discharge port, the fluid discharge system further includes a pair of squeezing members and a driving device which is associated with the pair of squeezing members and is used to drive the pair of squeezing members, wherein the pair of squeezing members are configured to operatively clamp the liner bag therebetween, and apply a squeezing force to the liner bag while the pair of squeezing members and the liner bag are relatively moving; and the driving device is associated with the pair of squeezing members and at least capable of driving one of the pair of squeezing members to move relative to the other, or the driving device is associated with the liner bag and enable the liner bag move relative to the pair of squeezing members.

Preferably, the pair of squeezing members are arranged to be able to descend as the liquid level in the liner bag decreases.

Preferably, the pair of squeezing members are a pair of rolling shafts, and the pair of rolling shafts can be rotated in opposite directions and provided with a rolling shaft squeezing segment and a rolling shaft locking portion, wherein the rolling shaft locking portion is used to operatively lock or loose the pair of rolling shafts, and the pair of rolling shafts are arranged to operatively clamp the liner bag between the rolling shaft squeezing segments, wherein after the liner bag is located between the rolling shaft squeezing segments of the pair of rolling shafts and the pair of rolling shafts are locked by the rolling shaft locking portions, the opposite rotation of the rolling shaft squeezing segments of the pair of rolling shafts will apply a squeezing force to the liner bag.

Preferably, the rolling shaft includes an elastic soft body and a supporting rod, and the elastic soft body is disposed around the supporting rod.

Preferably, each of the rolling shafts includes a supporting rod and an elastic soft body, the elastic soft body is disposed around the supporting rod, and an outer diameter of at least one portion of the elastic soft body uniformly varies in the axial direction to form a tapered elastic soft body.

Preferably, the liner bag is formed by hermetically welding a front panel and a rear panel, and the discharge port is disposed adjacent to a weld line at the bottom of the liner bag.

Preferably, the distance between the lower edge of the discharge port and the weld line of the bottom of the liner bag is less than or equal to 15 cm, and more preferably less than or equal to 10 cm.

Preferably, the liner bag further includes a flow guiding structure, which is disposed at at least one side of the discharge port.

Preferably, the flow guiding structure is an inclined face formed at the bottom of the liner bag.

According to another aspect of this invention, there provides a liquid discharge method for discharging viscous liquid in a liner bag, the liquid discharge method includes the following steps:

providing an squeezer comprising a pair of squeezing members and a driving device which is associated with the pair of squeezing members;

clamping a liner bag between the pair of squeezing members and applying a preclamping force to the liner bag;

driving one of the pair of squeezing members to move relative to the other, such that the pair of squeezing members and the liner bag move relative to each other while discharging the liquid.

Preferably, the pair of squeezing members are a pair of rolling shafts, and the driving device drives the two rolling shafts to rotate in opposite directions to squeeze the liquid in the liner bag out, during liquid discharging, with the reducing of the liquid in the liner bag, the pair of rolling shafts automatically descends as the liquid level decreases and squeeze the liquid under the driving of the driving device.

Preferably, the liner bag is formed by hermetically welding a front panel and a rear panel and provided with a hermetically welded discharge port which is disposed adjacent to a weld line at the bottom of the liner bag.

Preferably, the viscosity of the viscous liquid is greater than 300,000 CPS.

As used herein, the expression "includes a pair" means having at least one pair or at least two, and may be one pair, three, two pairs or more, for example, including a pair of squeezing members, which may be two, three or more squeezing members.

According to another aspect of this invention, there provides a fluid discharge system comprising a container and a liner bag, which is installed in the container, the fluid discharge system further includes a squeezing device and a driving device which is connected to the squeezing device and used to drive the squeezing device, wherein the squeezing device includes at least two rolling shafts, the liner bag is formed by hermetically welding a front panel and a rear panel and is provided with a discharge port which is disposed adjacent to a weld line at the bottom of the liner bag; when the liquid in the liner bag is needed to be discharged, the two rolling shafts clamp the liner bag, and under the driving of the driving device, the two rolling shafts rotate in opposite directions to squeeze the liquid in the liner bag out, and during the liquid discharging, with the reducing of the liquid in the liner bag, the two rolling shafts automatically descend as the liquid level decreases and squeeze the liquid under the driving of the driving device.

Preferably, the container is an intermediate bulk container.

Preferably, the distance between the lower edge of the discharge port and a weld line of the bottom of the liner bag is less than or equal to 15 cm, and more preferably less than or equal to 10 cm.

Preferably, the discharge port is hermetically welded to the front panel or the rear panel of the liner bag.

Preferably, the liner bag further includes a flow guiding structure, which is disposed at at least one side of the discharge port.

Preferably, the flow guiding structure is an inclined face formed at the bottom of the liner bag.

Preferably, the bottom of the liner bag is formed with a plurality of inclined faces, and the plurality of inclined faces are inclined toward the discharge port, so that the liquid in the liner bag can be converged to the discharge port of the liner bag along the plurality of inclined faces during discharging.

Preferably, the bottoms of the front panel and the rear panel of the liner bag form inclined edges which cooperates with each other, so that when the front panel and the rear panel are welded to each other to form a liner bag, the inclined face is formed at the bottom of the liner bag.

Preferably, the bottoms of the front panel and the rear panel of the liner bag form two inclined edges which cooperates with each other, so that when the front panel and the rear panel are welded to each other to form a liner bag, two inclined faces are formed at the bottom of the liner bag, and the two inclined faces are inclined toward the discharge port, so that liquid in the liner bag can be converged to the discharge port of the liner bag along the two inclined faces during discharging.

Preferably, the squeezing device further includes transmission gears, the transmission gears are disposed on the two rolling shafts, and when the two rolling shafts are connected to each other, the transmission gears on the two rolling shafts engage with each other, when the driving device drives one of the rolling shafts to rotate, the other rolling shaft can be driven to rotate, so that the two rolling shafts move downward along the liner bag and squeeze the liquid in the liner bag out.

Preferably, the transmission gears are disposed at two ends of the rolling shafts.

Preferably, the rolling shaft includes an elastic soft body and a supporting rod, and the elastic soft body is disposed around the supporting rod.

Preferably, each of the rolling shafts includes a supporting rod and an elastic soft body, the elastic soft body is disposed around the supporting rod, and an outer diameter of at least one portion of the elastic soft body uniformly varies in the axial direction to form a tapered elastic soft body.

Preferably, the outer diameter of the elastic soft body uniformly varies in the axial direction from one end to the other end to form a tapered elastic soft body.

Preferably, the squeezing device further includes squeezing brackets, one end of the supporting rod of the rolling shaft is mounted in the squeezing brackets, and the gears are mounted around the supporting rod and disposed in the squeezing brackets.

Preferably, the squeezing device is composed of two parts, each part including the rolling shaft, a squeezing bracket and a gear, the two ends of the rolling shafts are respectively installed in two squeezing brackets, and at least one end of the rolling shaft is provided with a gear, which is mounted around a portion of the rolling shaft that is located in the squeezing bracket, and in use, the first part and the second part clamp the liner bag and are fixed by cooperation of the squeezing brackets at two ends of each rolling shaft.

Preferably, the squeezing device further includes a supporting rod, two ends thereof are connected to the squeezing brackets at two ends of the rolling shafts.

Preferably, the squeezing device further includes two supporting rods.

Preferably, the squeezing bracket of the first part is provided with a connector, and the squeezing bracket of the second part is provided with a mating connector, the first part and the second part are fixed with each other by connecting the connector and the mating connector.

Preferably, the connector is a connecting pin provided on one side of the squeezing bracket of the first part, and the mating connector is a connecting hole provided on one side of the squeezing bracket of the second part, the first part and the second part are connected with each other by inserting the connecting pin into the connecting hole.

Preferably, a locking structure is disposed on the squeezing bracket of the first part of the squeezing device, and the squeezing bracket of the second part of the squeezing device is provided with a mating locking structure, the first part and the second part are locked through cooperation of the locking structure and the mating locking structure.

Preferably, the locking structure includes a locking hook, and the mating locking structure is a locking post, the locking hook can be hanged on the locking post by rotating the locking hook, so as to lock the first part and the second part with each other.

Preferably, the transmission device includes a motor, a gearbox and an assembling base, the motor is connected with the gearbox, the assembling base is disposed on a side of the gearbox and is provided with a driving member therein, and the driving member is provided with a driving hole, a driving shaft is provided on an end of the supporting rod for cooperation with the driving hole, wherein one end of the squeezing bracket is accommodated in the assembling base, and the driving shaft of the rolling shaft is accommodated in the driving hole.

Preferably, the rolling shaft includes an elastic soft body and a supporting rod, and the elastic soft body is disposed around the supporting rod.

Preferably, the supporting rod includes a first segment, a second segment, a third segment and a driving shaft, the outer diameter of the first segment is less than that of the second segment, wherein the gear is installed on the second segment, the first segment and the second segment are mounted in the squeezing bracket, the driving shaft is formed by the third segment integrally extending outward from an end thereof.

Preferably, the outer diameter of the driving shaft is less than that of the first segment.

Preferably, the elastic soft body is disposed around the perimeter of the third segment.

According to another aspect of this invention, there provides a fluid discharge system comprising a container and a liner bag which is installed in the container, the fluid discharge system further includes an squeezing device and a driving device which is connected to the squeezing device and used to drive the squeezing device, wherein the squeezing device includes at least two rolling shafts, the liner bag is formed by hermetically welding a front panel and a rear panel and is provided with a hermetically welded discharge port and a flow guiding structure, the discharge port is disposed adjacent to a weld line at the bottom of the liner bag, and the flow guiding structure is disposed at at least one side of the discharge port, when the liquid in the liner bag is needed to be discharged, the two rolling shafts clamp the liner bag, and under the driving of the driving device, the two rolling shafts rotate relative to each other to squeeze the liquid in the liner bag out, and during liquid discharging, with the reducing of the liquid in the liner bag, the two rolling shafts are always automatically descend as the liquid level decreases and squeeze the liquid under the driving of the driving device.

Preferably, the container is an intermediate bulk container.

Preferably, the distance between the lower edge of the discharge port and a weld line of the bottom of the liner bag is less than or equal to 15 cm, and more preferably less than or equal to 10 cm.

Preferably, the flow guiding structure is an inclined face formed at the bottom of the liner bag.

Preferably, the bottom of the liner bag is formed with a plurality of inclined faces, and the plurality of inclined faces are inclined toward the discharge port, so that liquid in the liner bag can be converged to the discharge port of the liner bag along the plurality of inclined faces during discharging.

Preferably, the bottoms of the front panel and the rear panel of the liner bag form inclined edges which cooperates with each other, so that when the front panel and the rear panel are welded to each other to form a liner bag, an inclined face is formed at the bottom of the liner bag.

Preferably, the bottoms of the front panel and the rear panel of the liner bag form two inclined edges which cooperates with each other, so that when the front panel and the rear panel are welded to each other to form a liner bag, two inclined faces are formed at the bottom of the liner bag, and the two inclined faces are inclined toward the discharge port, so that liquid in the liner bag can be converged to the discharge port of the liner bag along the two inclined faces during discharging.

According to yet another aspect of this invention, there also provides a fluid discharge system comprising a container and a liner bag which is installed in the container, the fluid discharge system further includes an squeezing device and a driving device which is connected to the squeezing device and used to drive the squeezing device, wherein the squeezing device comprises at least two rolling shafts, which at least comprise one tapered segment respectively, the liner bag is formed by hermetically welding a front panel and a back panel and is provided with a hermetically welded discharge port, and the discharge port is arranged adjacent to the weld line of the bottom of the liner bag; when the liquid in the liner bag is needed to be discharged, the two rolling shafts clamp the liner bag, and under the driving of the driving device, the two rolling shafts rotate in opposite directions to squeeze the liquid in the liner bag out, during liquid discharging, with the reducing of the liquid in the liner bag, the two rolling shafts automatically descend as the liquid level decreases and squeeze the liquid under the driving of the driving device, and enable the liquid in the liner bag convergently flow to the discharge port.

Preferably, each of the rolling shafts includes a supporting rod and an elastic soft body, the elastic soft body is disposed around the supporting rod, and an outer diameter of at least one portion of the elastic soft body uniformly varies in the axial direction to form a tapered elastic soft body.

Preferably, the outer diameter of the elastic soft body uniformly varies from one end to the other end to form a tapered elastic soft body.

According to another aspect of this invention, there also provides a fluid discharge system comprising a container and a liner bag which is installed in the container, the fluid discharge system further includes an squeezing device and a driving device, the driving device being connected to the squeezing device and used to drive the squeezing device, wherein the squeezing device comprises at least two rolling shafts, which at least include one tapered segment respectively, the liner bag is formed by hermetically welding a front panel and a rear panel and provided with a hermetically welded discharge port and a flow guiding structure, the discharge port being arranged adjacent to the weld line at bottom of the liner bag, when the liquid in the liner bag is needed to be discharged, the two rolling shafts clamp the liner bag, and under the driving of the driving device, the two rolling shafts rotate in opposite directions to squeeze the liquid in the liner bag out; during liquid discharging, with the reducing of the liquid in the liner bag, the two rolling shafts automatically descend as the liquid level decreases and squeeze the liquid under the driving of the driving device, and enable the liquid in the liner bag covergently flow to the discharge port along the flow guiding structure.

Preferably, the container is an intermediate bulk container.

Preferably, the distance between the lower edge of the discharge port and the weld line of the bottom of the liner bag is less than or equal to 15 cm, and more preferably less than or equal to 10 cm.

Preferably, the discharge port is hermetically welded to the front panel or the rear panel of the liner bag.

Preferably, the flow guiding structure is an inclined face formed at the bottom of the liner bag.

Preferably, the bottom of the liner bag is formed with a plurality of inclined faces, and the plurality of inclined faces are inclined toward the discharge port, so that liquid in the liner bag can be converged to the discharge port of the liner bag along the plurality of inclined faces during discharging.

Preferably, the bottoms of the front panel and the rear panel of the liner bag form inclined edges which cooperates with each other, so that when the front panel and the rear panel are welded to each other to form a liner bag, an inclined face is formed at the bottom of the liner bag.

Preferably, the bottoms of the front panel and the rear panel of the liner bag form two inclined edges which cooperates with each other, so that when the front panel and the rear panel are welded to each other to form a liner bag, two inclined faces are formed at the bottom of the liner bag, and the two inclined faces are inclined toward the discharge port, so that liquid in the liner bag can be converged to the discharge port of the liner bag along the two inclined faces during discharging.

According to the last aspect of this invention, there provides a liquid discharge method for discharging the liquid in a liner bag, assisting in discharging the liquid in the liner bag with an squeezing device and a driving device, the squeezing device comprises at least two rolling shafts, and the liner bag is formed by hermetically welding a front panel and a rear panel and provided with a hermetically welded discharge port, the discharge port being arranged adjacent to a weld line of the bottom of the liner bag, and the method includes:

clamping the liner bag with the two rolling shafts, the driving device drives the two rolling shafts to rotate in opposite directions to squeeze the liquid in the liner bag out, and during liquid discharging, with the reducing of the liquid in the liner bag, the two rolling shafts automatically descend as the liquid level decreases and squeeze the liquid under the driving of the driving device.

Preferably, the container is an intermediate bulk container.

Preferably, the distance between the lower edge of the discharge port and the weld line of the bottom of the liner bag is less than or equal to 15 cm, and more preferably less than or equal to 10 cm.

Preferably, the liner bag further includes a flow guiding structure, which is disposed at least one side of the discharge port.

Preferably, the flow guiding structure is an inclined face formed at the bottom of the liner bag.

Preferably, the bottom of the liner bag is formed with a plurality of inclined faces, and the plurality of inclined faces are inclined toward the discharge port, so that liquid in the liner bag can be converged to the discharge port of the liner bag along the plurality of inclined faces during discharging.

Preferably, the bottoms of the front panel and the rear panel of the liner bag form inclined edges which cooperates with each other, so that when the front panel and the rear panel are welded to each other to form a liner bag, the inclined face is formed at the bottom of the liner bag.

Preferably, the bottoms of the front panel and the rear panel of the liner bag form two inclined edges which cooperates with each other, so that when the front panel and the rear panel are welded to each other to form a liner bag, two inclined faces are formed at the bottom of the liner bag, and the two inclined faces are inclined toward the discharge port, so that liquid in the liner bag can be converged to the discharge port of the liner bag along the two inclined faces during discharging Preferably, the two rolling shafts at least include one tapered segment respectively, which cooperate with each other to converge the fluid in the liner bag to the discharge port during t discharging.

Preferably, each of the rolling shafts includes a supporting rod and an elastic soft body, the elastic soft body is disposed around the supporting rod, and an outer diameter of at least one portion of the elastic soft body uniformly varies in the axial direction to form a tapered elastic soft body.

Preferably, the outer diameter of the elastic soft body uniformly varies from one end to the other end to form a tapered elastic soft body.

Preferably, the viscosity of the viscous liquid is greater than 300,000 CPS.

Preferably, the container body includes a base and side plates which are mounted on the base and foldable relative to the base Preferably, the first part and the second part of the squeezing device are detachably mounted on two inner sides of the container respectively, the first part and the second part are mated and fixed relative to each other in use.

Preferably, the first part and the second part of the squeezing device are placed outside of the container after separated or connected to each other.

Preferably, the first part and the second part of the squeezing device are placed at the same side of the container after connected to each other.

Preferably, the squeezing device and the driving device can be integrated to form an squeezing device with its own driving device.

According to yet another aspect of this invention, there provides a fluid discharge system comprising a container and a liner bag which is provided with a discharge port and installed in the container, the fluid discharge system further includes an squeezing device and a driving device which is connected to the squeezing device and used to drive the squeezing device, wherein the squeezing device comprises at least two rolling shafts, when the liquid in the liner bag is needed to be discharged, the two rolling shafts clamp the liner bag, and under the driving of the driving device, the two rolling shafts rotate in opposite directions to squeeze the liquid in the liner bag out, during liquid dischargeing, with the reducing of the liquid in the liner bag, the two rolling shafts automatically descend as the liquid level decreases under the driving of the driving device and always squeeze the liquid in the liner bag off by opposite rotation thereof.

Preferably, the container is an intermediate bulk container.

Preferably, the squeezing device further includes transmission gears, the transmission gears are disposed on the two rolling shafts, and when the two rolling shafts are connected to each other, the transmission gears on the two rolling shafts engage with each other, when the driving device drives one of the rolling shafts to rotate, the other rolling shaft can be driven to rotate, so that the two rolling shafts move downward along the liner bag and squeeze the liquid in the liner bag out.

Preferably, the transmission gears are disposed at two ends of the rolling shafts.

Preferably, the rolling shaft includes an elastic soft body and a supporting rod, and the elastic soft body is disposed around the supporting rod.

Preferably, the squeezing device further includes squeezing brackets, one end of the supporting rod of the rolling shaft is mounted in the squeezing brackets, and the gears are disposed around the supporting rod and in the squeezing brackets.

Preferably, the squeezing device is composed of two parts, each part including the rolling shaft, an squeezing bracket and a gear, the two ends of the rolling shafts are installed in two squeezing brackets respectively, and at least one end of the rolling shaft is provided with a gear which is mounted around a portion of the rolling shaft that is located in the squeezing bracket, and in use, the first part and the second part clamp the liner bag and are fixed by cooperation of the squeezing brackets at two ends of each rolling shaft.

Preferably, the squeezing device further includes a supporting rod, two ends thereof are connected to the squeezing brackets at two ends of the rolling shafts respectively.

Preferably, the squeezing device includes two supporting rods.

Preferably, the squeezing bracket of the first part is provided with a connector, and the squeezing bracket of the second part is provided with a mating connector, the first part and the second part are fixed with each other by connecting the connector and the mating connector.

Preferably, the connector is a connecting pin provided on one side of the squeezing bracket of the first part, and the mating connector is a connecting hole provided on one side of the squeezing bracket of the second part, the first part and the second part are connected with each other by inserting the connecting pin into the connecting hole.

Preferably, a locking structure is disposed on the squeezing bracket of the first part of the squeezing device, and the squeezing bracket of the second part of the squeezing device is provided with a mating locking structure, the first part and the second part are locked through cooperation of the locking structure and the mating locking structure.

Preferably, the locking structure includes a locking hook, and the mating locking structure is a locking post, the locking hook can be hanged on the locking post by rotating the locking hook, so as to lock the first part and the second part with each other.

Preferably, the transmission device includes a motor, a gearbox and an assembling base, the motor is connected with the gearbox, the assembling base is disposed on one side of the gearbox and provided with a driving member therein, and the driving member is provided with a driving hole, a driving shaft is provided on the end of the supporting rod for cooperation with the driving hole, wherein one end of the squeezing bracket is accommodated in the assembling base, and the driving shaft of the rolling shaft is accommodated in the driving hole.

Preferably, the rolling shaft includes an elastic soft body and a supporting rod, and the elastic soft body is disposed around the supporting rod.

Preferably, the supporting rod includes a first segment, a second segment, a third segment and a driving shaft, the outer diameter of the first segment is less than that of the second segment, the outer diameter of the second segment is less than that of the third segment, wherein the gear is installed on the second segment, the first segment and the second segment are mounted in the squeezing bracket, the driving shaft is formed by the third segment integrally extending outward from an end thereof.

Preferably, the outer diameter of the driving shaft is less than that of the first segment.

Preferably, the elastic soft body is disposed around the perimeter of the third segment.

According to yet another aspect of this invention, there provides a fluid discharge system comprising a container and a liner bag which is provided with a discharge port and installed in the container, the fluid discharge system further includes an squeezing device and a driving device which is connected to the squeezing device and used to drive the squeezing device, wherein the squeezing device comprises at least two rolling shafts, at least one rolling shaft includes an elastic soft body disposed around an axis of the rolling shaft and located outside the rolling shaft, and the two rolling shafts clamp the liner bag when the liquid in the liner bag is needed to be discharged, under the driving of the driving device, the two rolling shafts rotate in opposite directions to squeeze the liquid in the liner bag out, and during liquid discharging, with the reducing of the liquid in the liner bag, the two rolling shafts automatically descend as the liquid level decreases under the driving of the driving device and always squeezing the liquid in the liner bag by opposite rotation thereof.

Preferably, the elastic soft body includes at least one segments with different outer diameters, the outer diameter thereof varies uniformly in axial direction.

Preferably, the segments with different outer diameters of the elastic soft body of the two rolling shafts cooperate with each other.

Preferably, the segments with different outer diameters of the elastic soft body of the two rolling shafts have equal lengths.

Preferably, the outer diameter of the elastic soft body of the rolling shaft uniformly varies from one end to the other end to form a tapered rolling shaft.

Preferably, the elastic soft body of each rolling shaft includes two tapered segments with uniformly varying outer diameter.

Preferably, the elastic soft body of each rolling shaft includes three tapered segments with uniformly varying outer diameter.

According to another aspect of this invention, there provides a liquid discharge method for discharging the liquid in a liner bag which is provided with a discharge port, the method comprising: assisting in discharging the liquid in the liner bag with an squeezing device and a driving device, the squeezing device comprising at least two rolling shafts; and clamping the liner bag with two rolling shafts; the driving device drives the two rolling shafts to rotate in opposite directions to squeeze the liquid in the liner bag out; during liquid discharging, with the reducing of the liquid in the liner bag, the two rolling shafts automatically descend as the liquid level decreases and squeeze the liquid in the liner bag by opposite rotation thereof.

Preferably, the viscosity of the viscous liquid is greater than 300,000 CPS.

Preferably, the container body includes a base and side plates which are mounted on the base and foldable relative to the bottom.

Preferably, the liner bag is formed by welding a front panel and a rear panel or by welding six side panels together.

Preferably, the rolling shaft of the squeezing device includes an elastic soft body and a supporting rod, the outer surface of the supporting rod is dealt with by glue coating, the elastic soft body is attached to and wrap the entire outer surface of the supporting rod, such that the supporting rod causes the synchronous rotation of the elastic soft body under the driving of the driving device.

Preferably, the supporting rod is made of rigid material.

Preferably, the first part and the second part of the squeezing device are detachably mounted on two inner sides of the container, the first part and the second part are mated and fixed relative to each other.

Preferably, the first part and the second part of the squeezing device are placed outside the container after separated or connected to each other.

Preferably, the first part and the second part of the squeezing device are installed at the same side of the container after connected to each other.

Preferably, the inner wall of the container is provided with rails on which the driving device are mounted, when squeezing, the driving device can move downward along the rails.

Preferably, the squeezing device and the driving device can be integrated to form an squeezing device with its own driving device.

Preferably, the fluid discharge system further includes a shovel operatively hermetically connected to the discharge port and operatively extending into the interior of the liner bag.

The intermediate bulk container provided in the invention does not need to hang a liner bag to form a zero residue discharge system, has a simple structure, a good manufacturing process, simple operation and is cost effective.

EMBODIMENTS

The preferred embodiment of this invention will be described in detail with reference to the accompanying drawings, so that the purposes, the characteristics and the advantages of the invention can be more clearly understood. It should be understood that the embodiments shown in the figures are not intended to limit the scope of this invention, but illustrate the essential spirit of the technical solution of this invention.

Description for Terms

Intermediate bulk container: composite intermediate bulk container (hereinafter referred to as IBC container in the following) is a type of packaging and transportation containers widely used in the food, biochemical, pharmaceutical, chemical and other industries in the world. Since IBC container barrels can be reused many times, they have obvious advantages in filling, storage, and transportation, and compared to cylindrical barrels, IBC container barrels can save 35% of storage space, the dimensions accord with ISO standards, and not only applicable to sterile can filling but also compact, convenient for safe and efficient storage in large scale, so it is widely used in the transportation, packaging, and storage of liquids, particles, and flakes etc. Currently, there are 820 L, 1000 L, and 1250 L existing specifications. Under normal circumstances, its structure includes plastic urchins, filling ports, discharge devices (valves or simple discharge ports, etc.), side panels, bases, and cover plates.

The fluid discharge system of the present invention generally comprises a container and a liner bag which is installed in the container and provided with a discharge port, wherein the container in which the liner bag is installed is usually an intermediate bulk container (IBC). The fluid discharge system of the present invention further includes an squeezing device and a driving device, which is connected to the squeezing device and used to drive the squeezing device, wherein the squeezing device includes at least one pair of squeezing members, such as at least two rolling shafts; when the liquid in the liner bag is needed to be discharged, the two rolling shafts clamp the liner bag, and the pair of squeezing members are relatively moved under the driving of the driving device, for example, the two rolling shafts are oppositely rotated, and apply a squeezing force to the liner bag to squeeze the liquid in the liner bag out; during liquid discharging, as the liquid in the liner bag decreases, the two rolling shafts automatically descend with the liquid level under the driving of the driving device to squeeze the liquid. Herein, the squeezing force is produce squeezing and pushing effect to the object, for example the liner bag and the liquid contained therein.

Next, the first embodiment of this invention is described reference to figures.

The First Embodiment

Next, the first embodiment of this invention is described reference to FIGS. 1-23.

Figure 1:
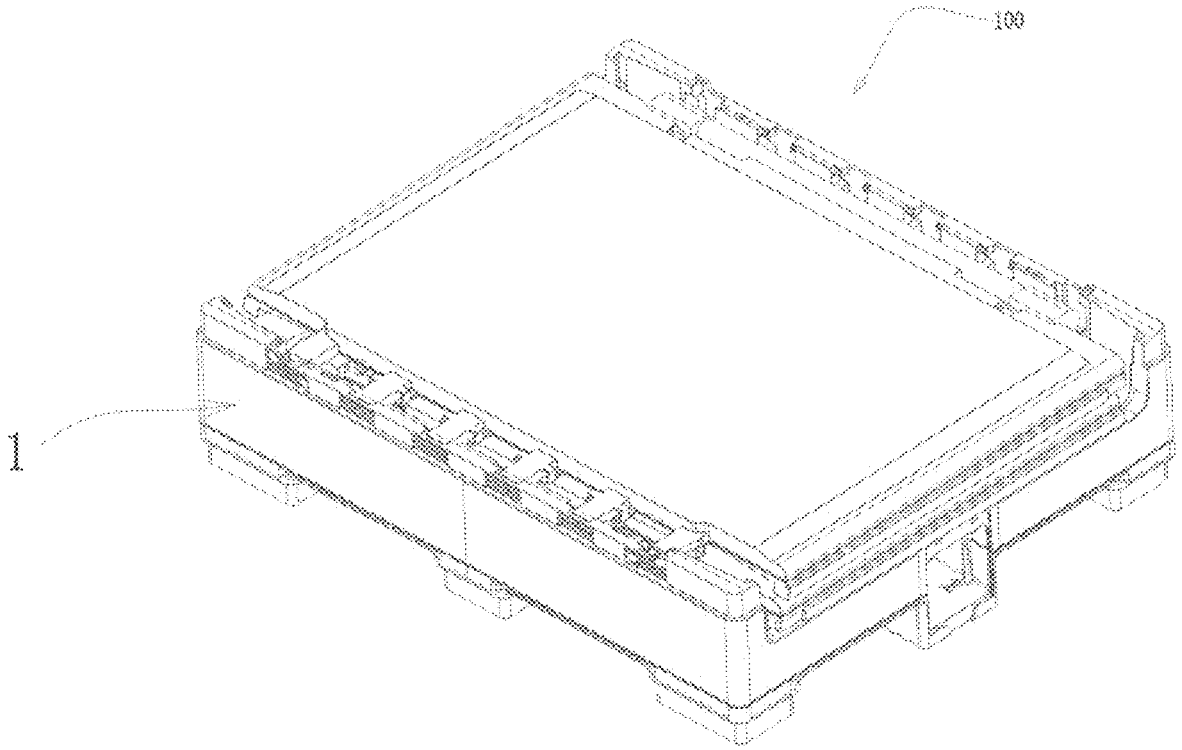
FIG. 1 is the perspective view of the liquid discharge system according to the first embodiment of this invention, wherein the side plates of the container is in the folded state.
Figure 2:
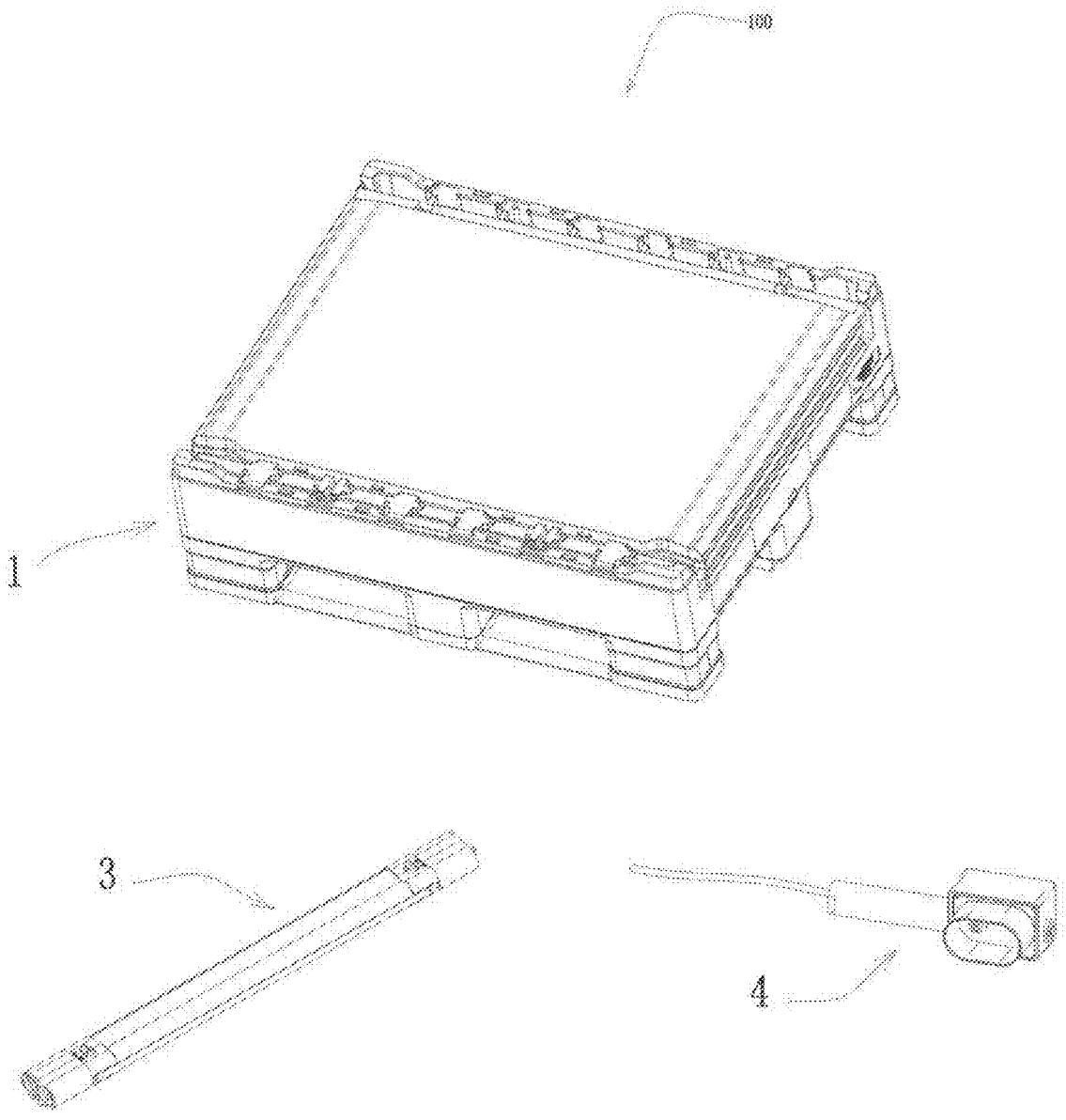
FIG. 2 is an explosive view of the liquid discharge system in FIG. 1.
Figure 3:
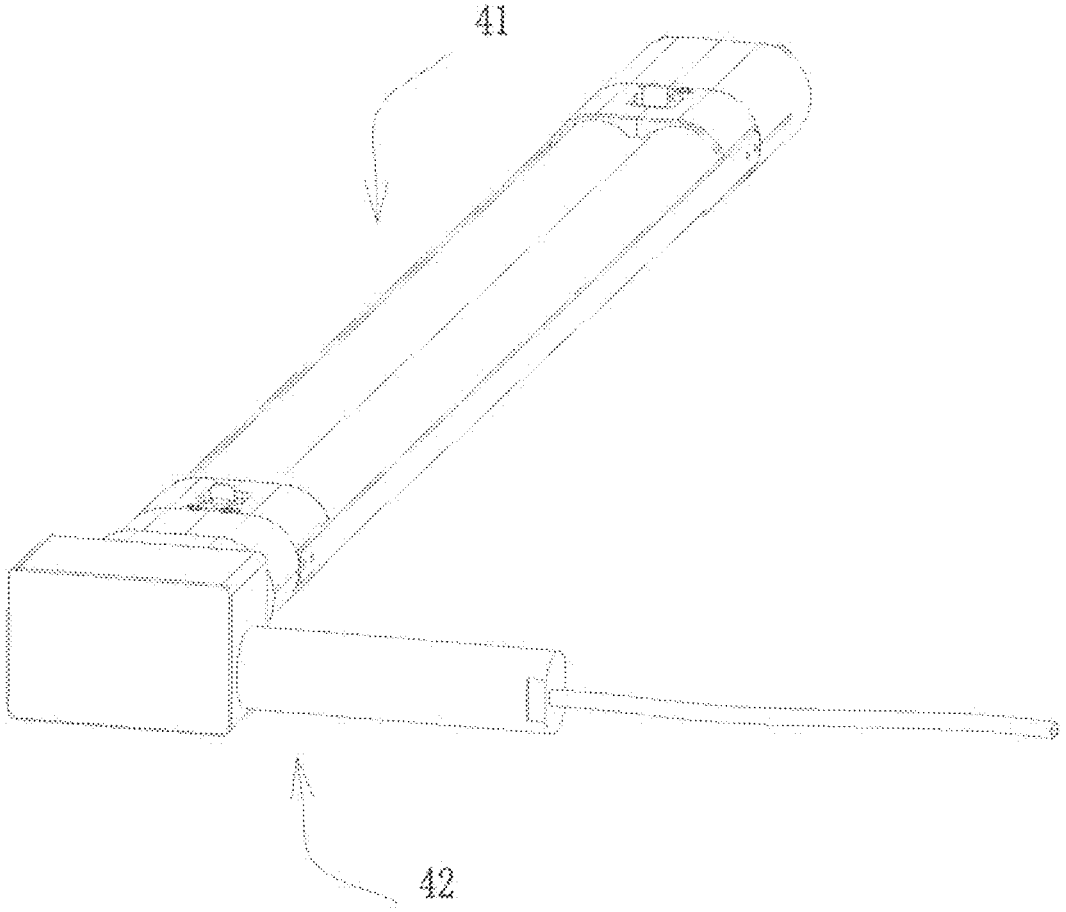
FIG. 3 is the perspective view of the squeezing device and driving device of the liquid discharge system according to the first embodiment of this invention, wherein the squeezing device and the driving device are assembled together.
Figure 4:
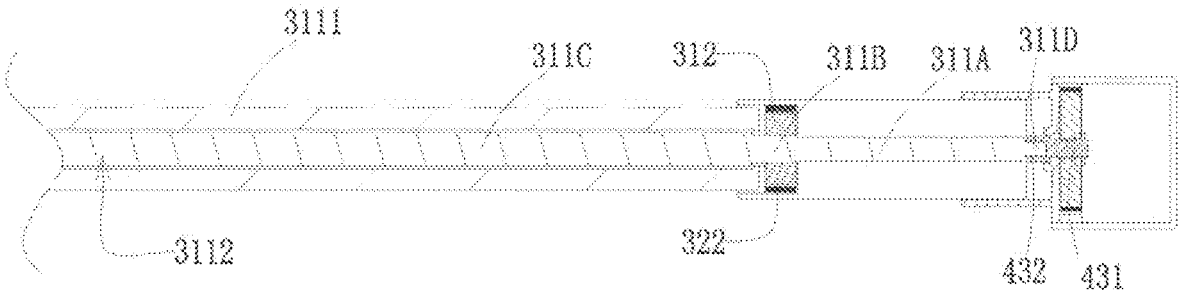
FIG. 4 is the explosive view of the squeezing device and the driving device in FIG. 3.
Figure 17:
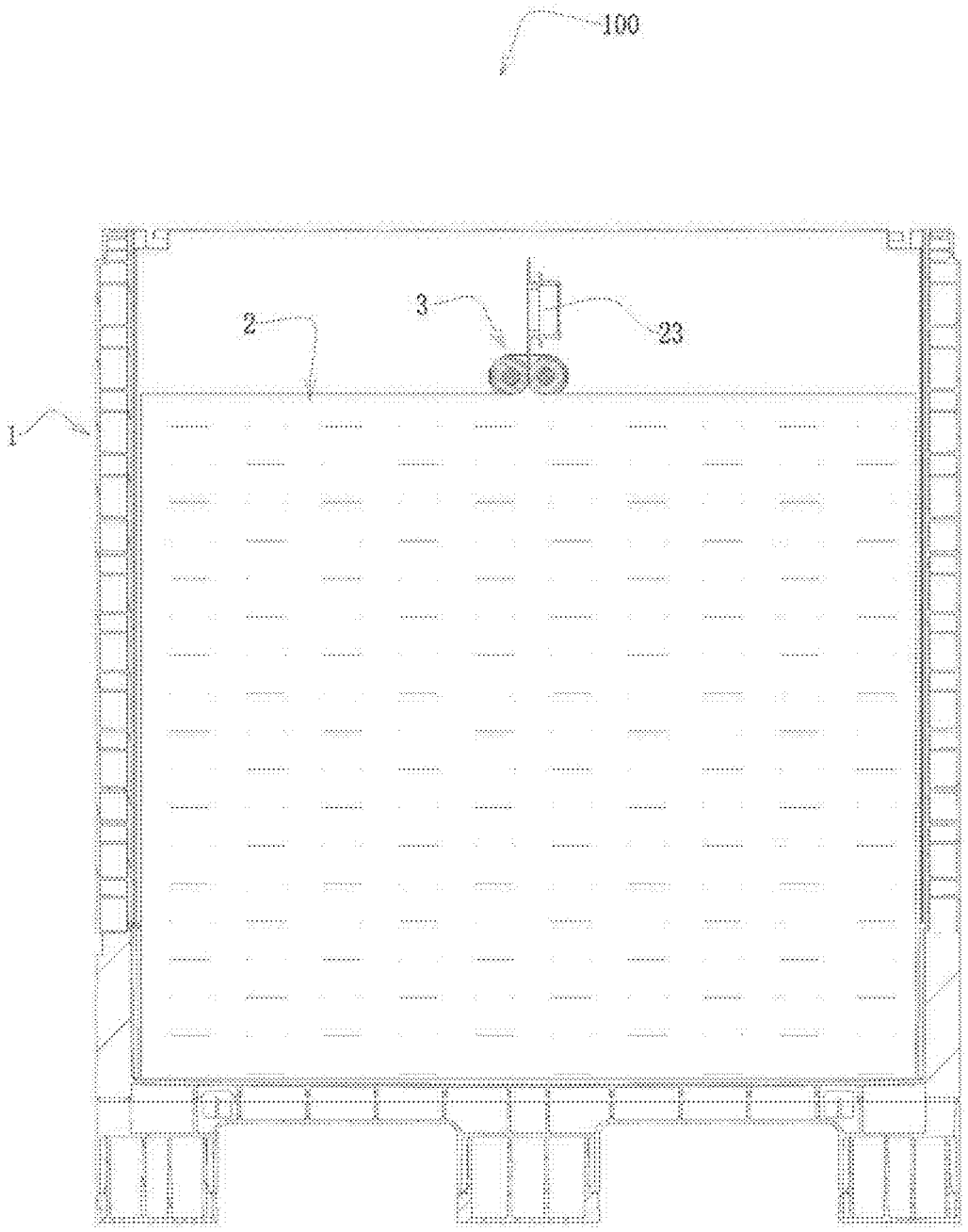
FIGS. 17-20 are the cross-sections of the discharge system according to the first embodiment of this invention, showing the process of the liquid discharging of the discharge system of this invention.
Figure 18:
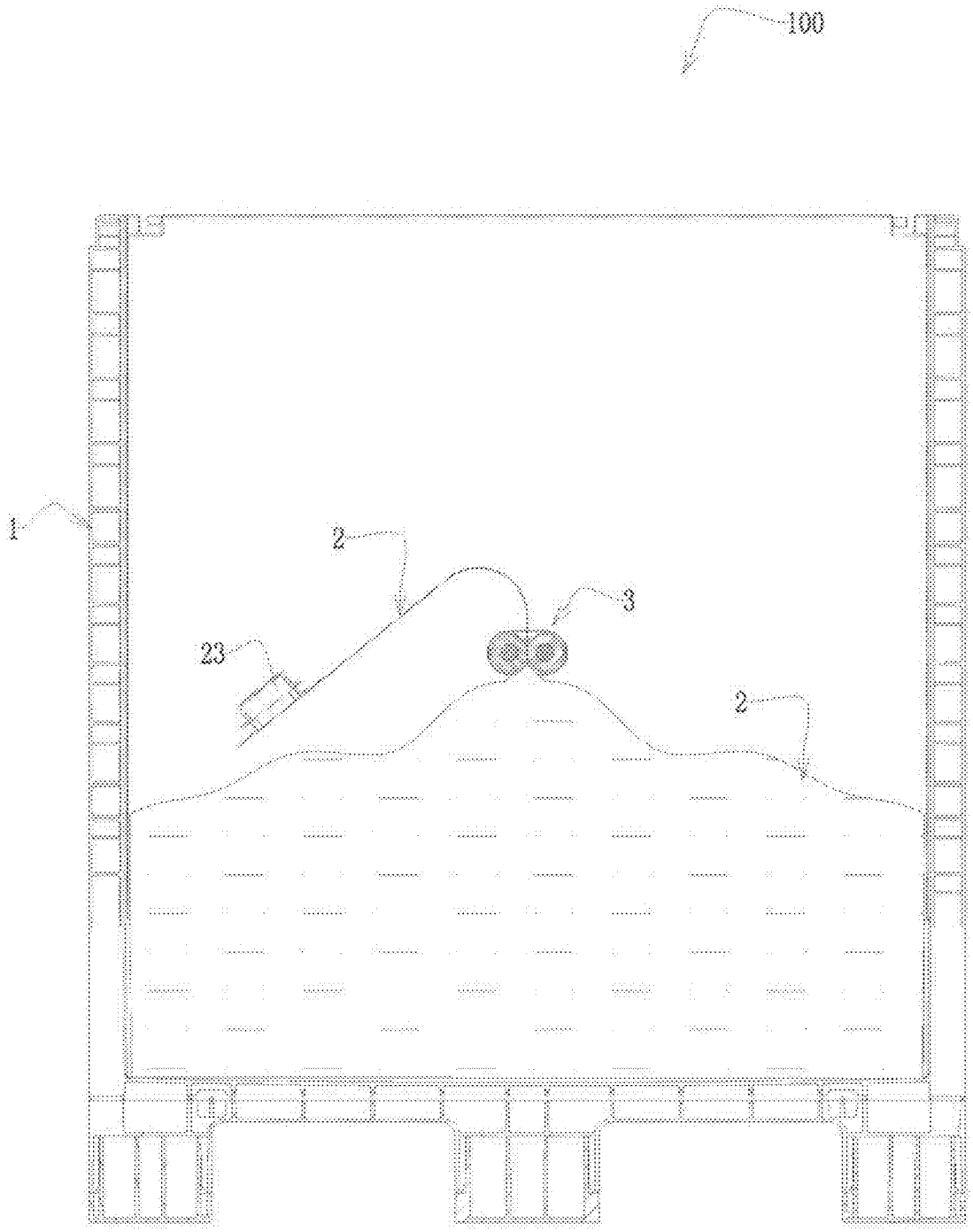
Figure 19:
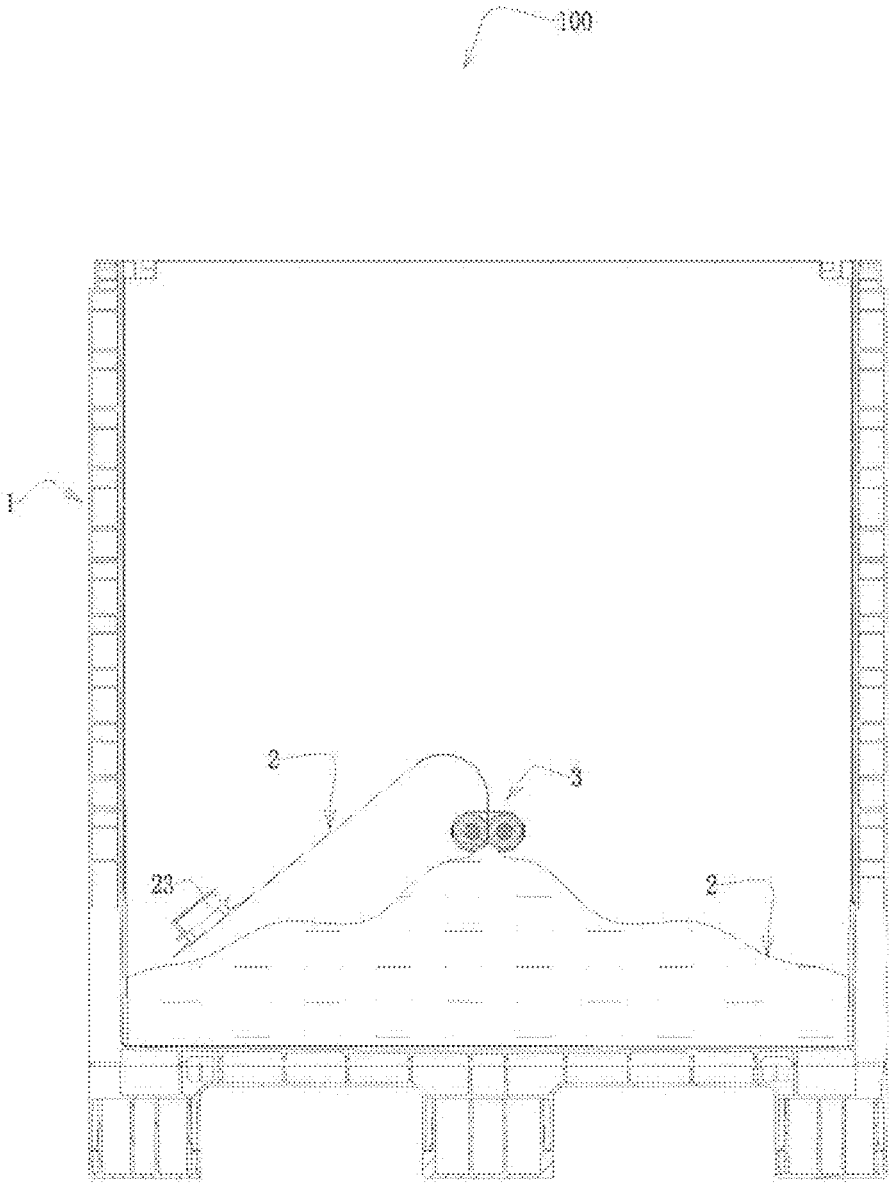
Figure 20:
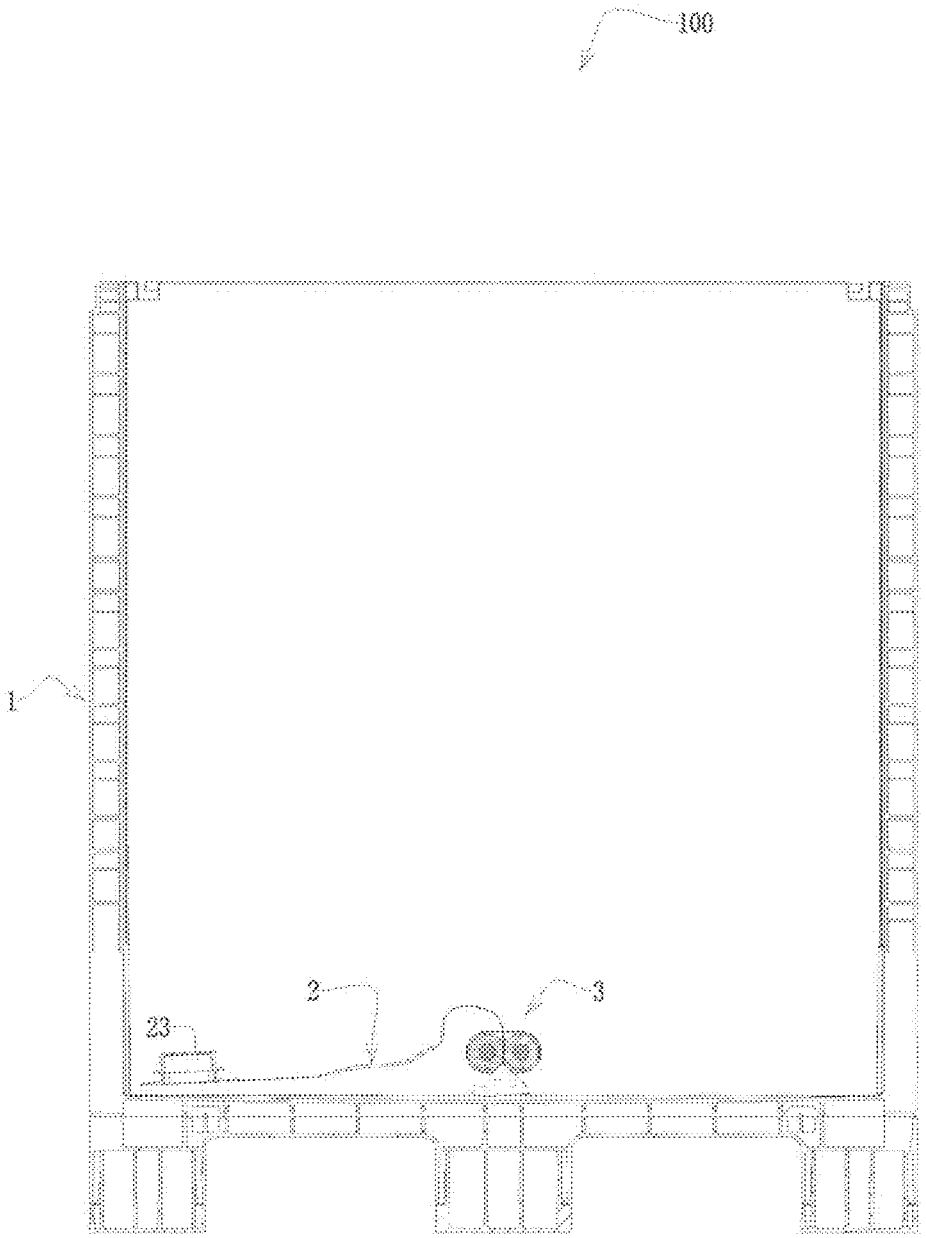

FIG. 1 is the perspective view of the liquid discharge system according to the first embodiment of this invention, wherein the side plates of the container is in the folded state;

FIG. 2 is an explosive view of the liquid discharge system; FIG. 3 is the perspective view of the squeezing device and driving device of the liquid discharge system according to the first embodiment of this invention, wherein the squeezing device and the driving device are assembled together; FIG. 4 is the explosive view of the squeezing device and the driving device in FIG. 3; and FIG. 17 is the perspective view of the discharge system according to this embodiment.

As shown in FIGS. 1-4 and 17, the liquid discharge system 100 includes a container 1, a liner bag 2 provided in the container 1, an squeezing device 3 and a driving device 4, wherein the squeezing device 3 commonly at least includes two rolling shafts (which will be described in detail later). When discharging is required, the squeezing device 3 and the driving device 4 are placed in the container, for example on the inside wall of the container. And, when the discharging of the liquid in the liner bag is desired, the bag body of the liner bag is clamped by two rolling shafts of the squeezing device 3 (that is passing the bag body of the liner bag between the two rolling shafts), and the driving device 4 is connected with the squeezing device 3, so that under the driving of the driving device 4, the two rolling shafts of the squeezing device 3 rotate downward oppositely and squeeze the bag body of the liner bag 2, so as to squeeze the liquid in the liner bag out, during liquid discharging, as the liquid in the liner bag decreases, the two rolling shafts automatically descend with the liquid level under the driving of the driving device and squeeze the liquid.

Next, the squeezing device 3 and the driving device 4 of the liquid discharge system 100 of this embodiment will be described with reference to FIGS. 3-11.

Figure 5:
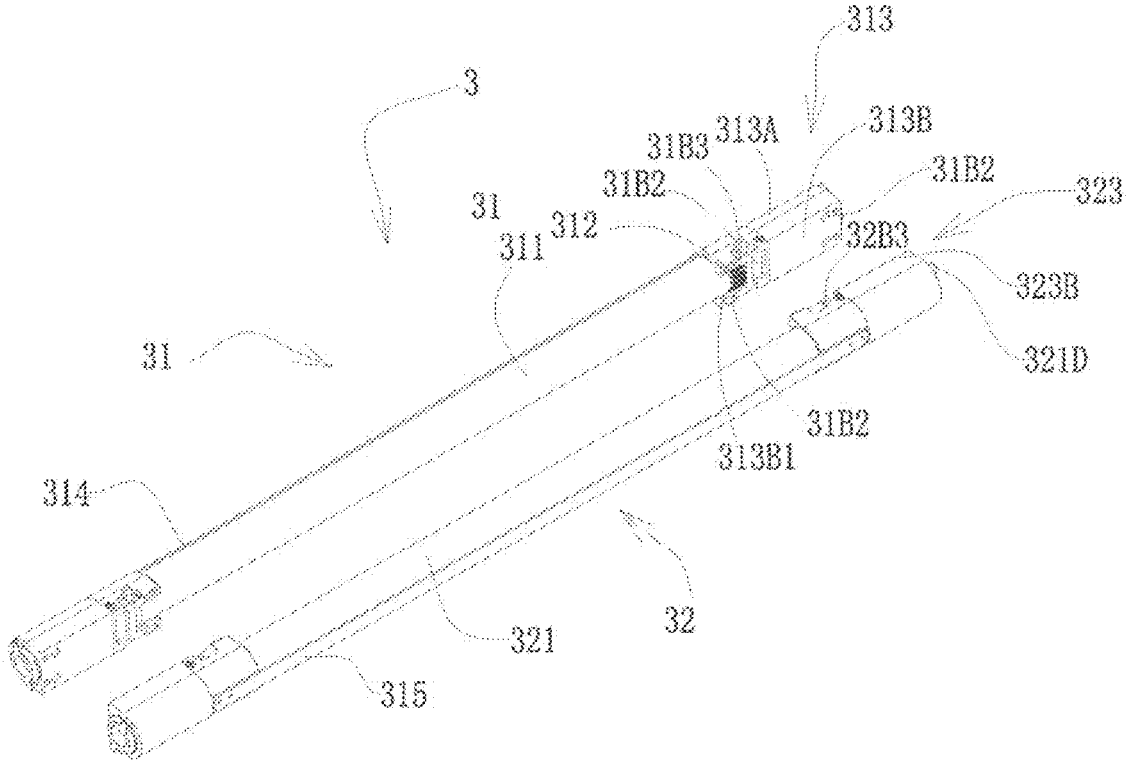
FIGS. 5-7 are the perspective views of the squeezing device 3 according to the first embodiment of this invention, showing the process of the squeezing device of this invention changing from the separating state to connecting state.
Figure 6:
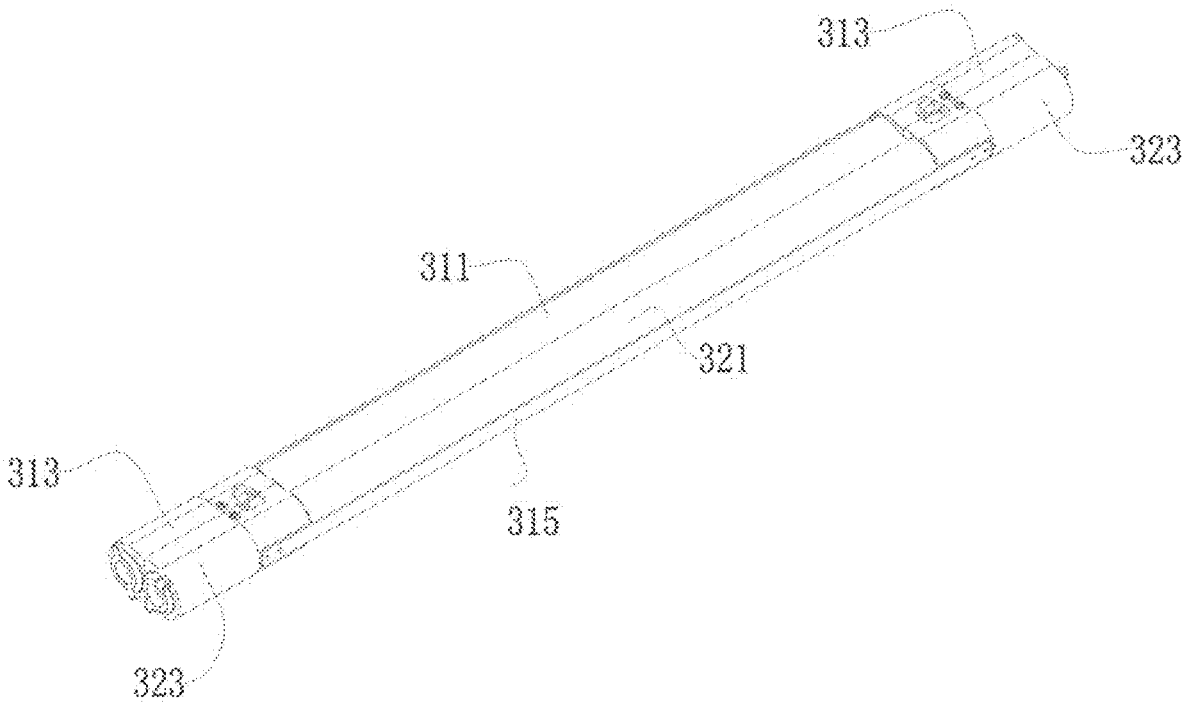
Figure 7:
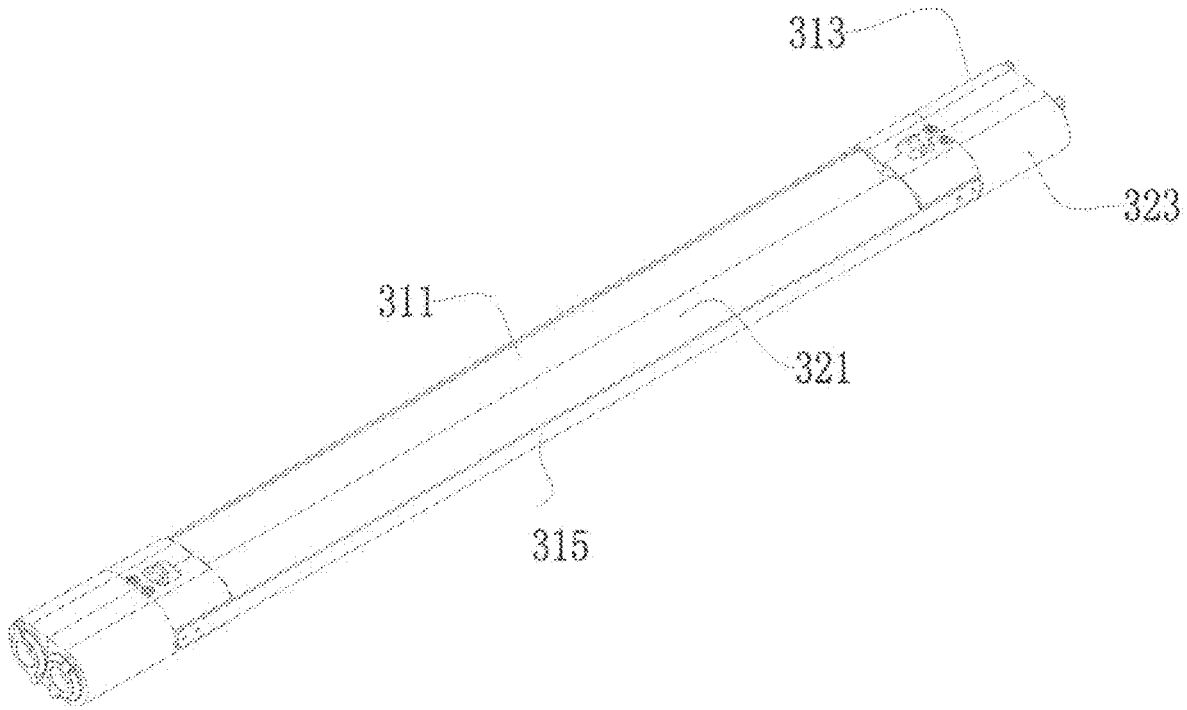
Figure 8:
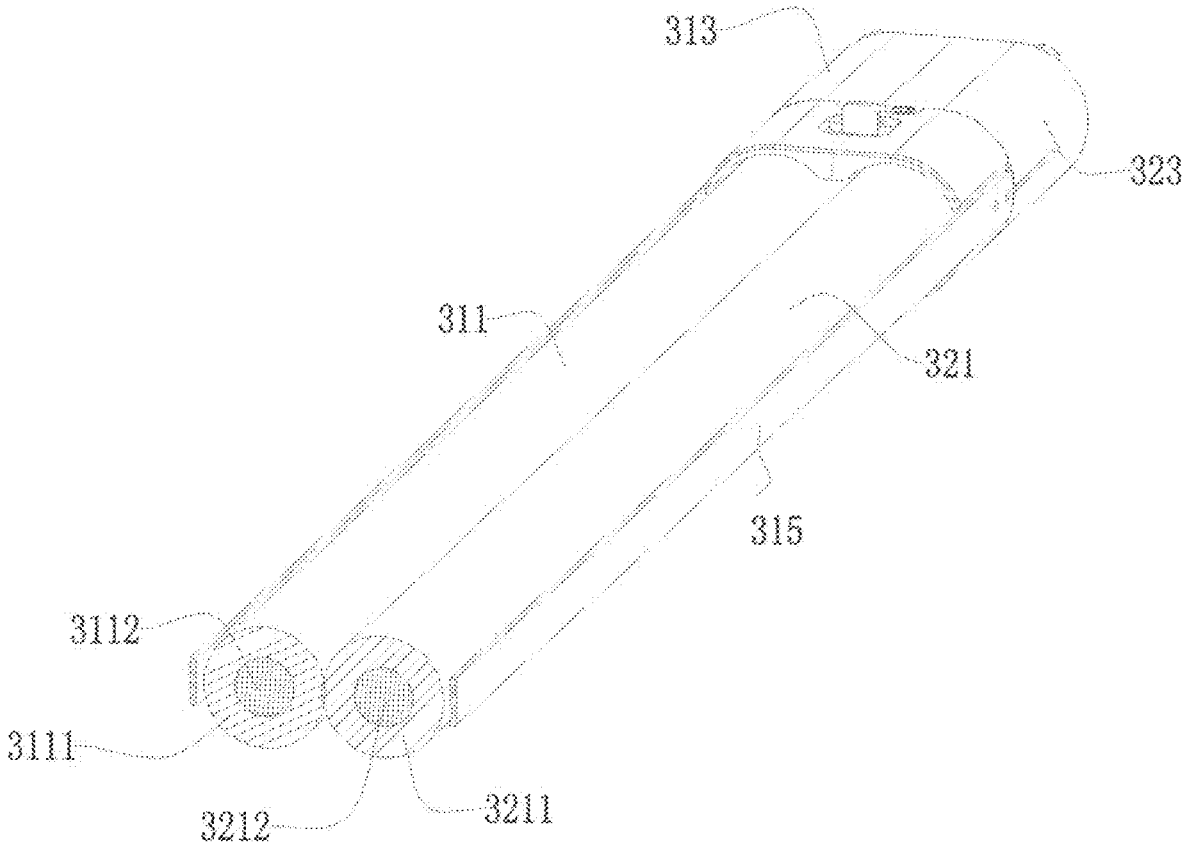
FIG. 8 is a perspective cross-section of the squeezing device 3 in FIG. 7.
Figure 9:
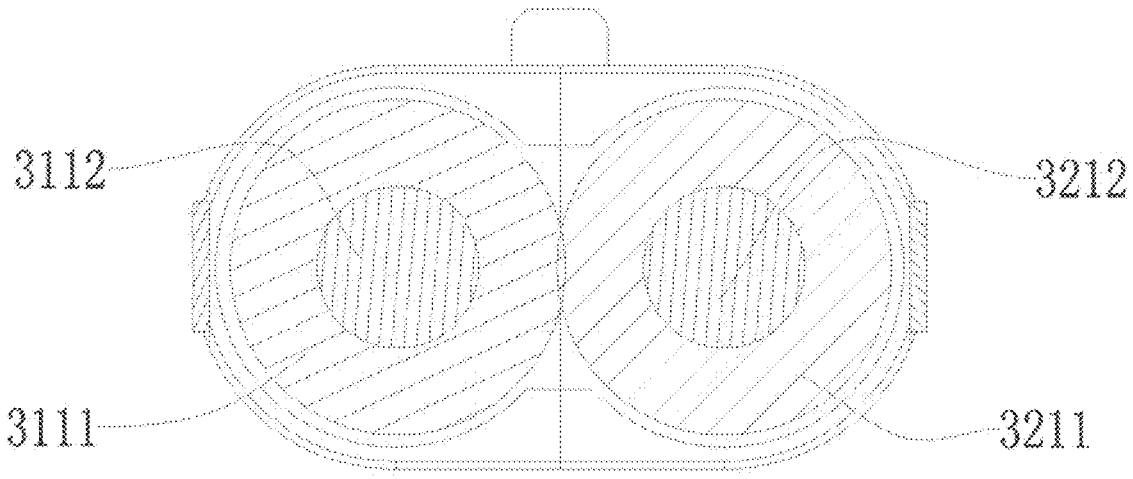
FIG. 9 is the end view of FIG. 8.
Figure 10:
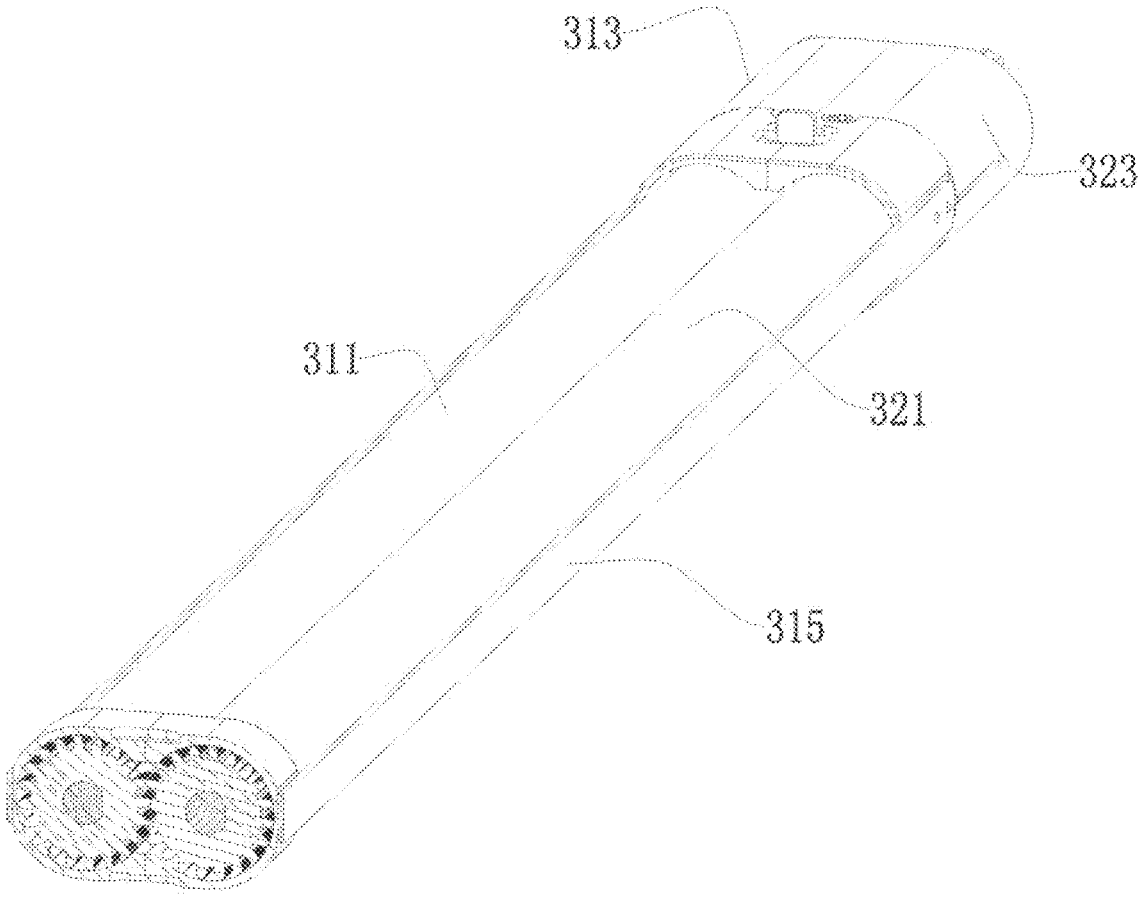
FIG. 10 is another perspective view of the squeezing device 3 according to the first embodiment of this invention, showing the engaging state of gears.
Figure 11:
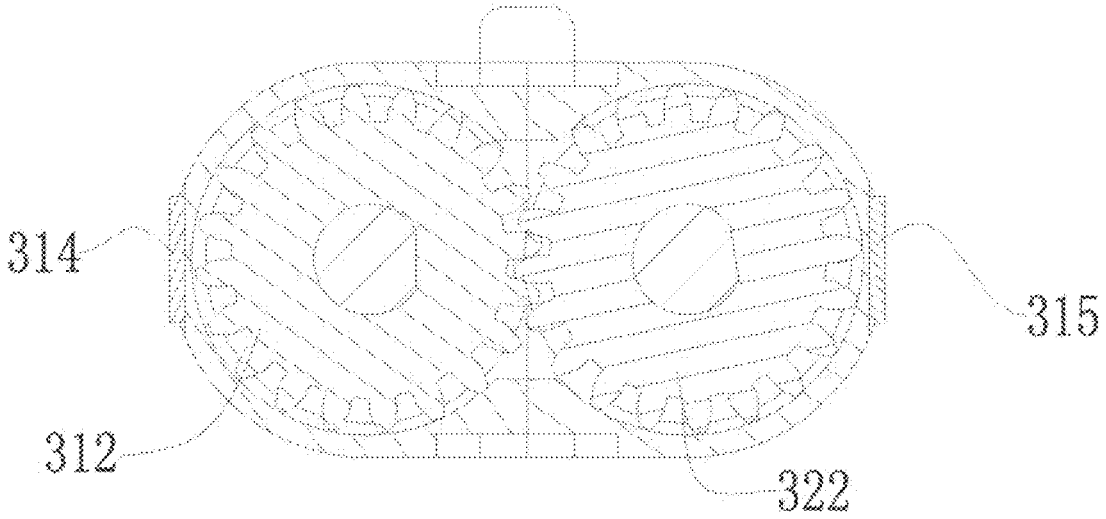
FIG. 11 is the end view of FIG. 10.

FIGS. 5-7 are the perspective views of the squeezing device 3 in this invention, showing the process of the squeezing device 3 of this invention changing from the separating state to the connecting state. FIG. 8 is a perspective cross-section view of the squeezing device 3 in FIG. 7, FIG. 9 is the end view of FIG. 8, FIG. 10 is another perspective view of the squeezing device 3 of this invention, showing the engaging state of gears, FIG. 11 is the end view of FIG. 10.

As shown in FIGS. 3-11, the squeezing device 3 includes a first part 31 and a second part 31, the structures of the first part 31 and the second part 32 are almost the same. The first part 31 includes a rolling shaft 311, a gear 312 and squeezing rackets 313. The squeezing bracket 313 has a cavity which is open at both ends, one end of the rolling shaft 311 is mounted in the cavity of the squeezing bracket 313, and the gear 312 is mounted around the rolling shaft and also in the cavity of the squeezing bracket 313.

As shown in FIG. 5, in this invention, the rolling shaft 311 is rod-shaped, the axial dimension thereof is much larger than the radial dimension thereof, and the length of the squeezing racket is much lesser than the length of the rolling shaft 311, so that only a certain length of the rolling shafts 311 at two ends thereof are received in the cavity, the remaining immediate part is used to contact with the bag body of the liner bag 2, so as to squeeze the bag body, as will be described later.

Figure 34:
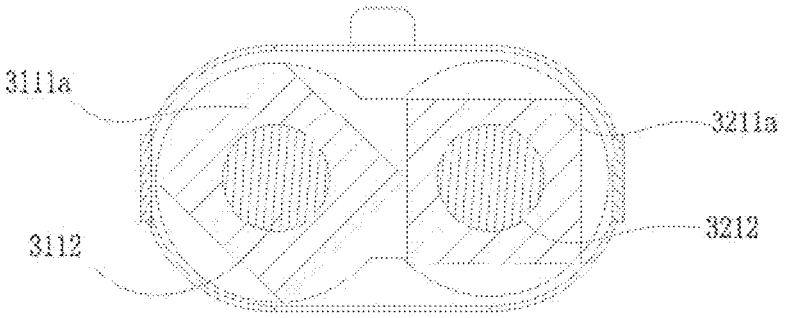
FIG. 34 shows the end view of a variant of the squeezing device shown in FIG. 9, which differs from the embodiment in FIG. 9 in the cross-section shape of the rolling shaft.

With reference to FIG. 4, in this embodiment, the rolling shaft 311 includes an elastic body 3111 and a supporting rod 3112, with the elastic body 3111 surrounding the supporting rod 3112. In particular, the elastic body 3111 is cylinder in shape, with inner cavity whose inner diameter matching the outer diameter of the supporting rod 3112 and the supporting rod 3112 extending into the inner cavity of the elastic body 3111. For example, the outer surface of the supporting rod 3112 can be coated with glue, and the elastic body 3111 is attached to and wrapped around the entire outer surface of the supporting rod 3112, so that the elastic body 3111 rotates synchronously with the supporting rod 3112 under the driving of the driving device. It should be understood that, the elastic body wrapped around the rolling shaft 311 can also has other shapes, such as oval, triangle or square in cross-section as shown in FIG. 34. The difference between the rolling shaft shown in FIG. 34 and the rolling shaft shown in FIG. 9 is only the cross-sectional shape of the elastic soft body 3111*a* and 3211*a* which are wrapped around the same, and the others are the same, which will not be described in detail herein.

Continuing to refer to FIG. 4, the supporting rod 3112 includes a first segment 311A, a second segment 311B and a third segment 311C, wherein the outer diameter of the first segment 311A is less than that of the second segment 311B, the outer diameter of the second segment 311B is less than that of the third segment 311C. The gear 312 is installed on the second segment 311B, both the first segment 311A and the second segment 311B are installed in the squeezing bracket 312, that is, the total length of the first segment 311A and the second segment 311B is generally equal to the length of the squeezing bracket 312, wherein a driving shaft 311D extends outwardly (in the right direction in FIG. 4) from one end of the first segment 311A integrally, the outer diameter of the driving shaft 311D is less than that of the first segment 311A, and is used to engage with a driving hole in the driving device 4, as further described later. The elastic body 3111 is disposed around the periphery of the third segment 311C.

With reference to FIG. 5, the outline of the squeezing bracket 313 is approximate semi-circular, which includes an arc surface 313A and a plane surface 313B which is used to engage with the plane surface of the squeezing bracket 323 of the second part. The squeezing bracket 313B1 is provided with an opening 313B1 in the plane surface of the part provided with gears, the size of the opening 313B1 is determined according to the actual process requirements, and the gear of the first part 31 and the gear of the second part 32 are meshed with each other through the opening 313B1.

Continuing to refer to FIG. 5, a connection structure is disposed on the plane surface 313B of the squeezing bracket 313 of the first part 31, and a mating connection structure is disposed on the plane surface 323B of the second part 32, through the mating of the connection structure and the mating connection structure, the first part 31 and second part 32 are fixed to each other. In this embodiment, the connecting structure on the squeezing bracket 313 of the first part 31 is a plurality of connecting holes 31B2, and the shapes and sizes of the holes may be the same or different, and the mating connection structure on the squeezing bracket 323 of the second part 32 is a plurality of connecting pins (not shown), and the shape and size of the connecting pins match the shape and size of the connecting holes 31B2 on the corresponding first part 31 respectively, by inserting the connecting pins of the second part 32 (not shown) into the connecting hole 31B2 of the first part 31, the first part 31 and the second part 32 are fixed to each other.

Although in this embodiment, only the connecting holes are provided on the squeezing bracket 313 of the first part 31, and only the connecting pins are provided on the squeezing bracket 323 of the second part 32, however, those skilled in the art can understand that the connecting holes can also be provided in the squeezing bracket 323 of the second part, a connecting pins can also be provided on the squeezing bracket 313 of the first part 31, or connecting holes or connecting pins are simultaneously provided in the squeezing brackets 313, 323 of the first part 31 and the second part 32, as long as these connecting holes or connecting pins match with each other.

Continuing to refer to FIG. 5, the squeezing bracket 313 of the first part 31 is provided with a locking structure, and the squeezing bracket 323 of the second part 32 is provided with a mating locking structure, through the cooperation of the locking structure and the mating locking structure, the first part 31 and the second part 32 are locked with each other. In this embodiment, the locking structure is a locking hook 31B3 disposed on the upper surface of the squeezing bracket 313 of the first part 31, and the mating locking structure is a locking post 32B3 disposed on the upper surface of the squeezing bracket 323 of the second part 32. The locking post 32B3 can hang the locking hook 31B3 on the locking post 32B3 by rotating the locking hook 31B3, thereby locking the first part 31 and the second part 32 with each other.

As shown in FIG. 5-8, in this embodiment, the first part 31 of the squeezing device further includes a supporting rod 314, two ends of the supporting rod 314 are connected to the squeezing brackets 313 at both ends of the rolling shaft 311 respectively, thereby the squeezing brackets at both ends of the rolling shaft are connected together.

In this embodiment, the structure of the second part 32 of the squeezing device 3 is substantially the same as that of the first part 31, and the same contents are not described in detail herein, and the description of the first part 31 above can be referred to.

As shown in FIGS. 3-11, the second part 32 includes a rolling shaft 321, a gear 322, and squeezing brackets 323. The rolling shaft 321 includes an elastic soft body 3211 and a supporting rod 3212. The elastic soft body 3211 is disposed around the supporting rod 3212. Specifically, the elastic soft body 3211 is cylindrical in shape, and has an inner cavity with an inner diameter matching the outer diameter of the supporting rod 3212. The supporting rod 3212 extends into the inner cavity of the elastic soft body 3211. The second part 32 of the squeezing device also includes a supporting rod 315, and two ends of the supporting rod 315 are connected to the squeezing brackets 323 at both ends of the rolling shaft 321 respectively, thereby the squeezing brackets 323 at both ends of the rolling shafts 321 are connected together.

The second part 32 differs from the first part 31 in that, the squeezing bracket 323 of the second part 32 of the squeezing device 3 is different from the squeezing bracket 313 of the first part 31. Referring to the above, in this embodiment, the squeezing bracket 323 of the second part 32 is provided with a plurality of connecting pins on the plane surface thereof, and the squeezing bracket 313 of the first part 31 is provided with a plurality of connecting holes in the plane surface thereof. However, it will be understood by those skilled in the art that connecting holes may be provided in the squeezing bracket 323 of the second part, and connecting pins may be provided on the first part 31 of the squeezing bracket 313, or both the connecting holes and the connecting pins are provided in the first part 31 and the second part 32 of the squeezing brackets 313 and 323 at the same time, as long as the connecting holes or connecting pins cooperate with each other.

Figure 12:
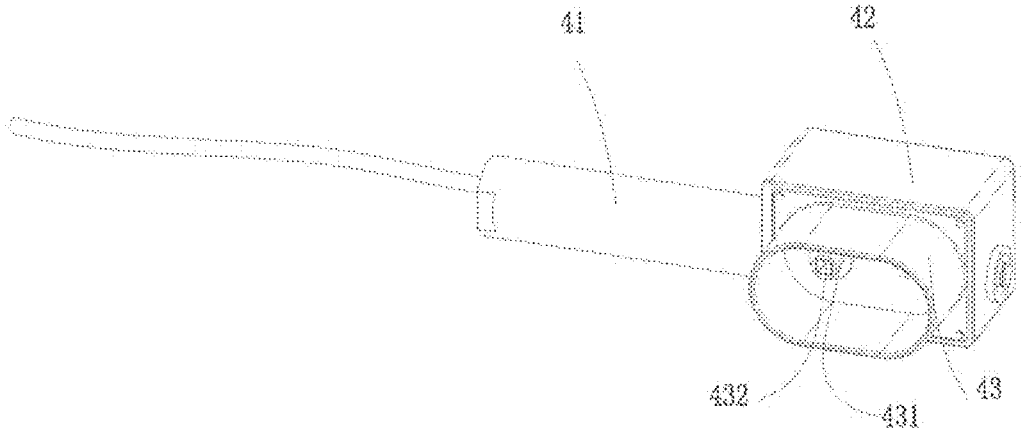
FIG. 12 is the perspective view of the driving device according to the first embodiment of this invention.
Figure 13:
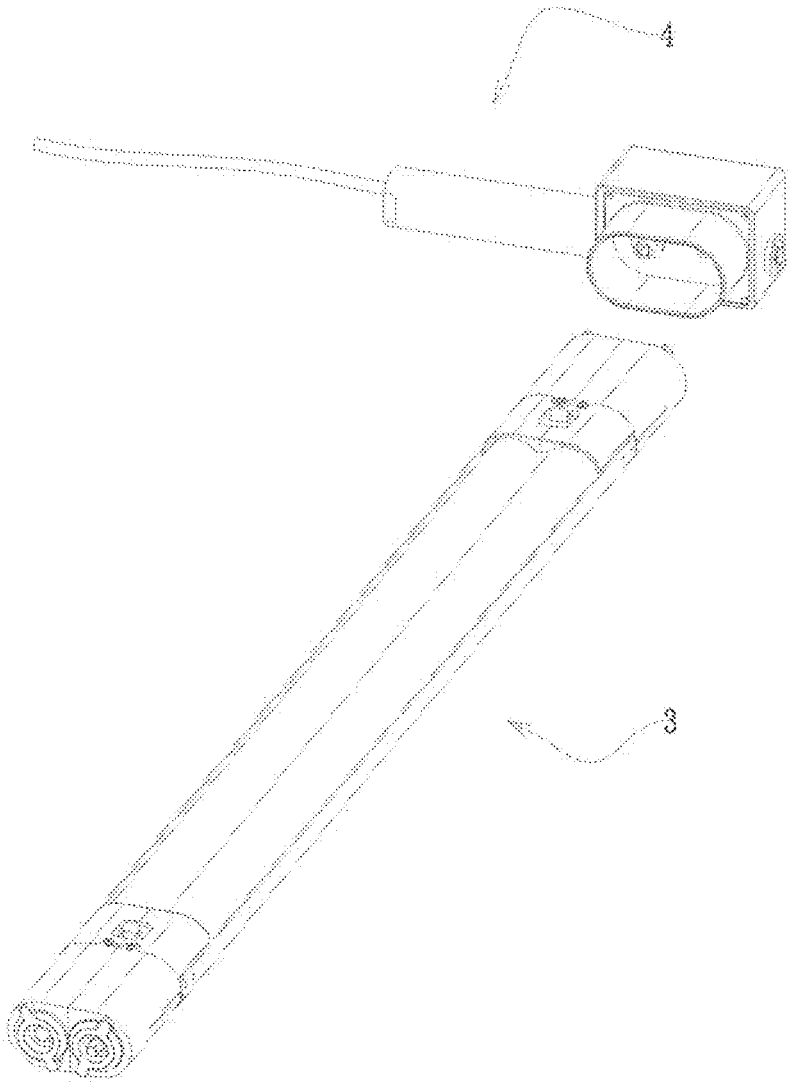
FIG. 13 is the assembled perspective view of the driving device and the squeezing device according to the first embodiment of this invention.

FIG. 12 is a perspective view of the driving device 4 of the present invention, and FIG. 13 is a perspective view showing the assembly of the driving device 3 and the squeezing device 4 of the present invention. As shown in FIGS. 12-13, the driving device 4 includes a motor 41, a gearbox 42 and an assembling base 43, the motor 41 is connected to the gearbox 42, the assembling base 43 is disposed on the side of the gearbox 42, and a driving member 431 is disposed in the assembling base 43. The end of the driving member 431 is provided with a driving hole 432 for engaging with the driving shaft 311D of the end portion of the supporting rod 311 of the first part 31 or the driving shaft 321D of the end portion of the supporting rod 321 of the second part 32, and both one end of the squeezing bracket 313 of the first part 31 and one end of the squeezing bracket 323 of the second part 32 are accommodated in the assembling base 43.

Figure 14:
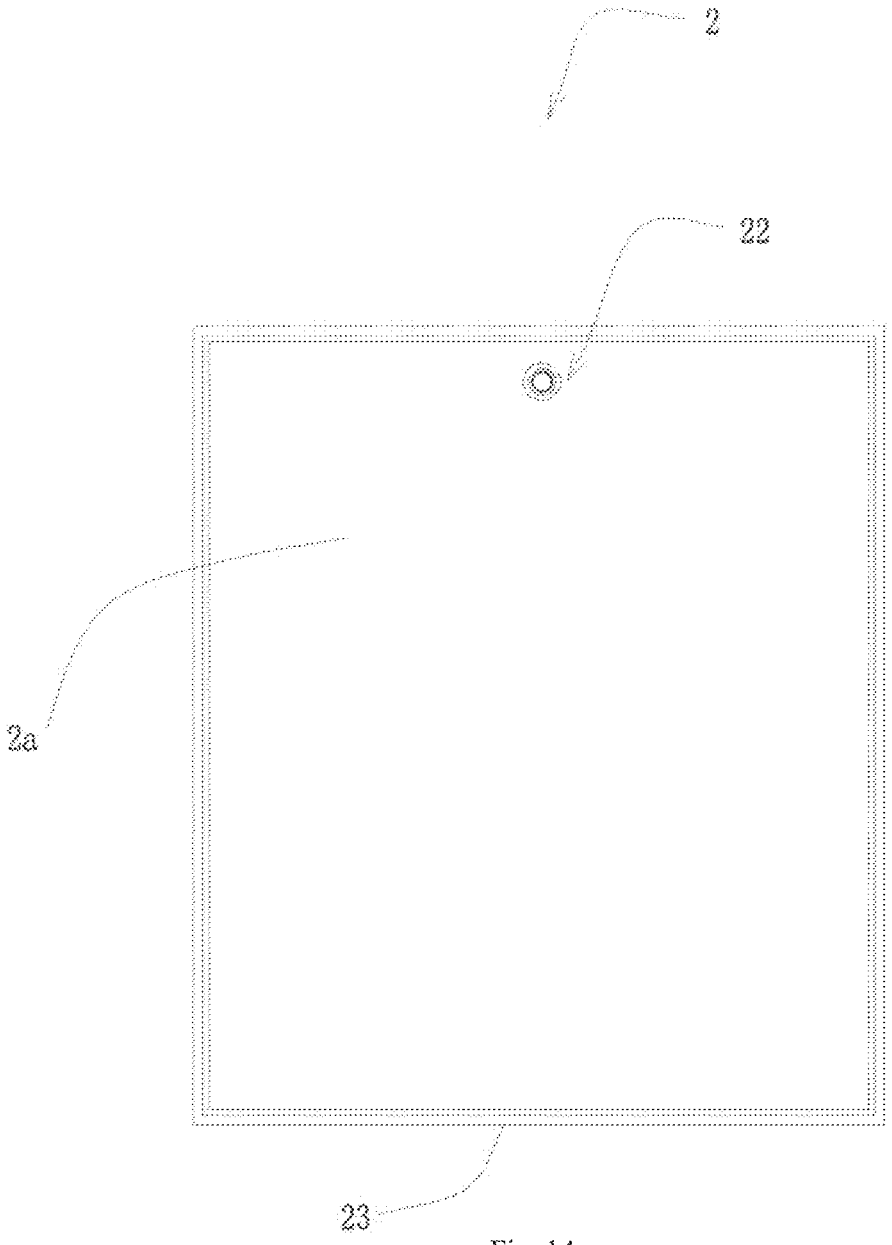
FIGS. 14-15 are the plan views of the liner bag according to the first embodiment of this invention.
Figure 15:
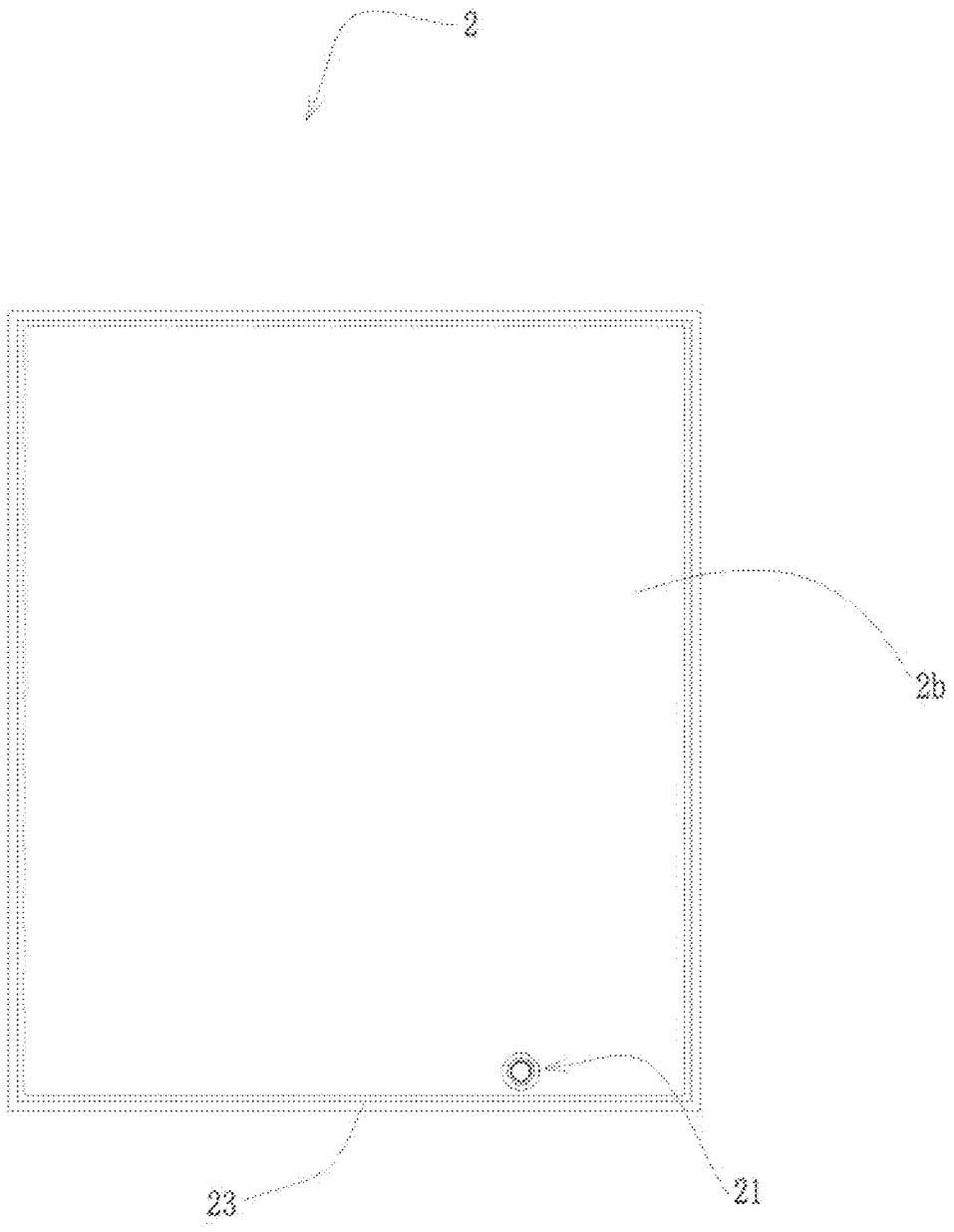

FIGS. 14-15 are plan views showing the liner bag 2 of the present embodiment. As shown in FIGS. 14-15, the liner bag 2 is formed by hermetically welding a front panel 2*a* and the rear panel 2*b*, a discharge port 21 is provided in the front panel 2*a* or the rear panel 2*b*. The discharge port 21 is arranged adjacent to the weld line 23 at the bottom of the liner bag 2. Generally, in the present invention, the distance between the lower edge of the discharge port 21 and the weld line of the bottom of the liner bag is less than or equal to 15 cm, and more preferably less than or equal to 10 cm. In this embodiment, the discharge port 21 is welded to the rear panel 2*b*, and a filling port 22 is welded to the upper portion of the front panel 2*a*, the filling port 22 is used to filling liquid (usually a viscous liquid with a viscosity of more than 300,000 CPS), and the discharge port 21 is used to discharge liquid (usually a viscous liquid with a viscosity greater than 300,000 CPS). In this embodiment, the liner bag 2 is formed by hermetically welding a regular front panel 2*a* and a regular rear panel 2*b* (for example, a rectangular front panel 2*a* and a rectangular rear panel 2*b*).

The liner bag of this embodiment is formed by hermetically welding a front panel and a rear panel, and the discharge port is disposed adjacent to the weld line at the bottom of the liner bag. Therefore, when the liquid is filled in the liner bag, the discharge port is located substantially at the center line of the bottom of the liner bag. That is, the liner bag is substantially axially symmetric about the discharge port, so that during liquid discharging, the liquid can be thoroughly discharged from the liner bag relatively through the discharge port.

Figure 16:
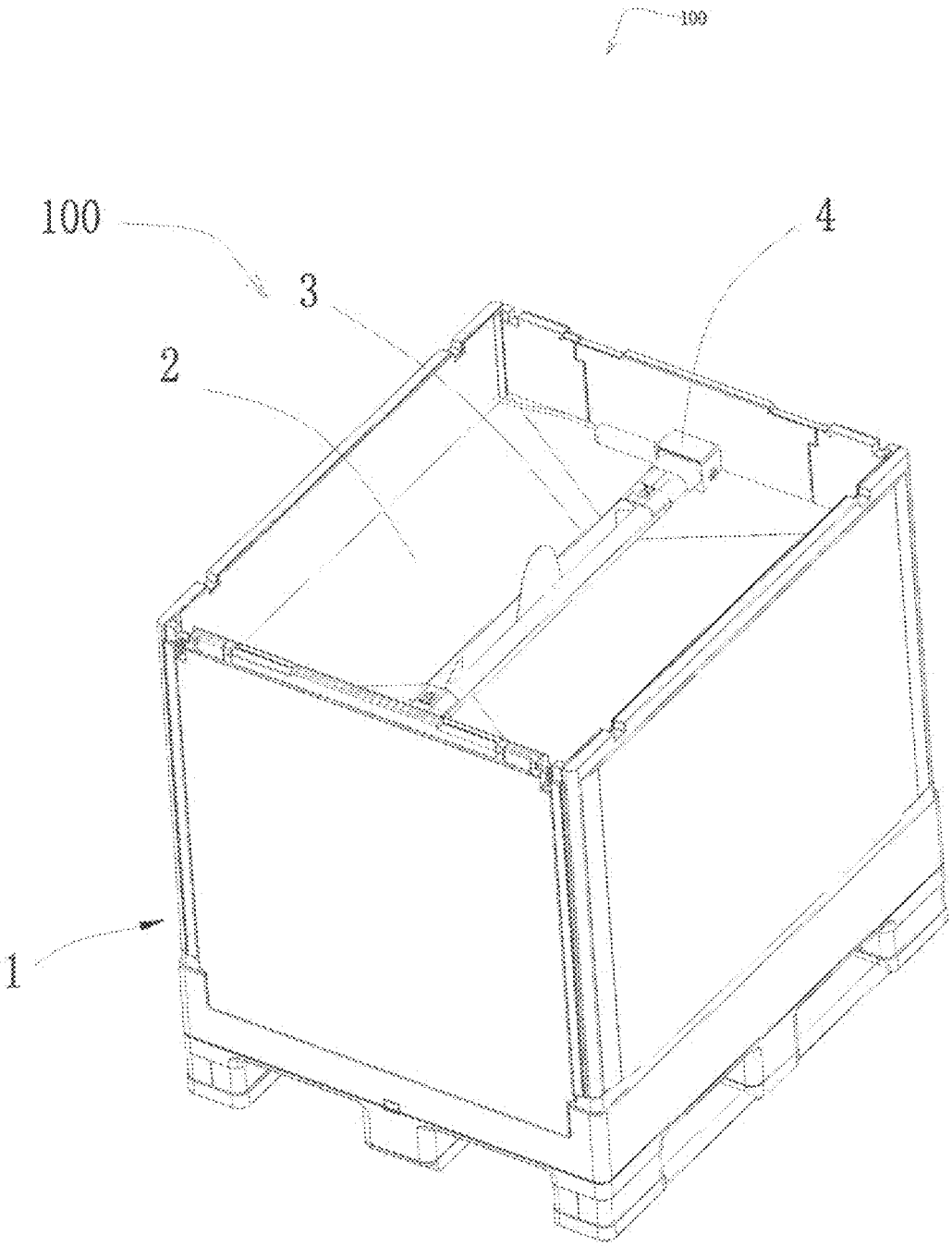
FIG. 16 is the perspective view of the discharge system according to the first embodiment of this invention.
Figure 21:
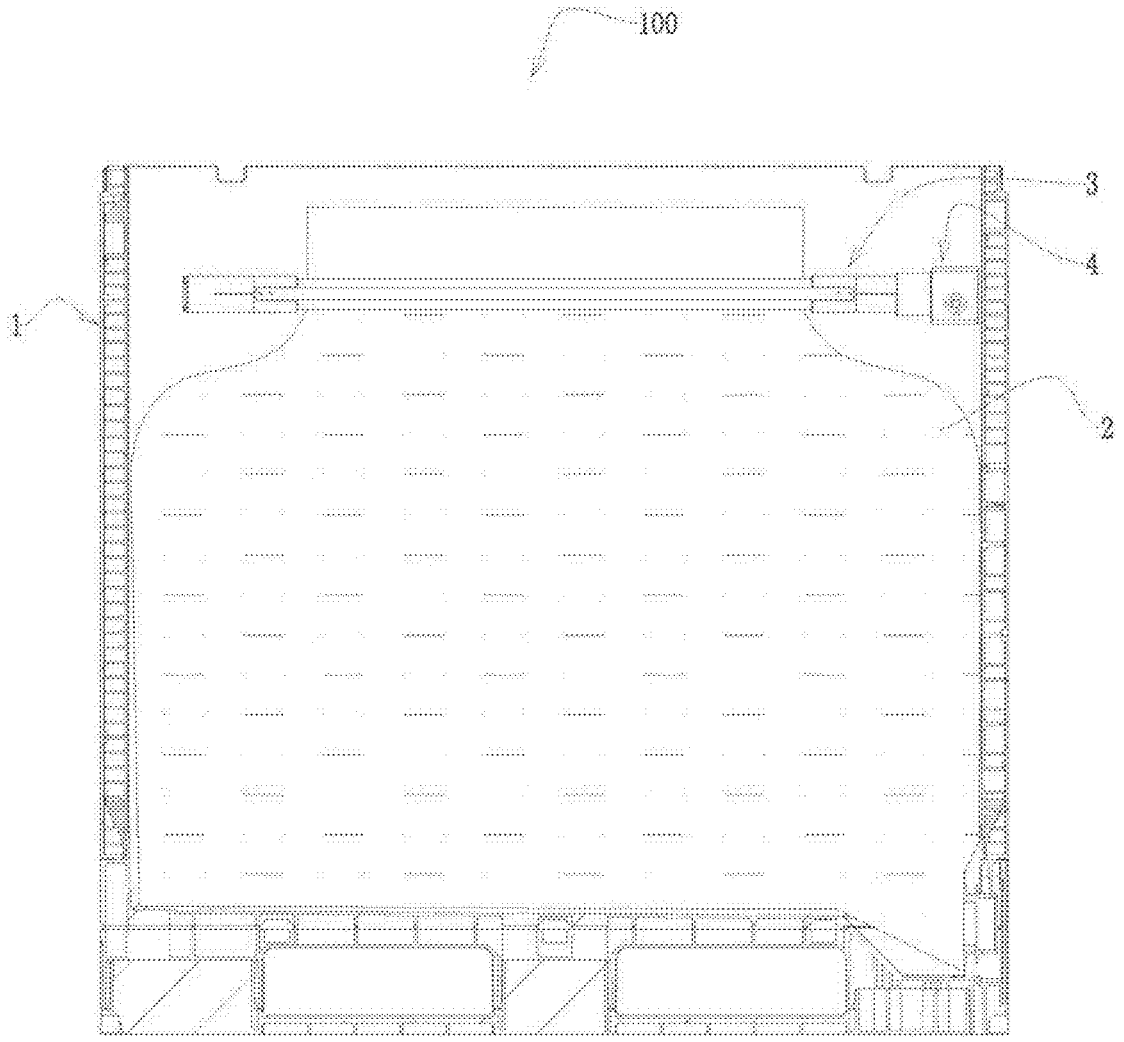
FIGS. 21-23 are cross-section views taken along another section plane of the discharge system according to the first embodiment of this invention, showing the state of different phases during discharging process respectively.
Figure 22:
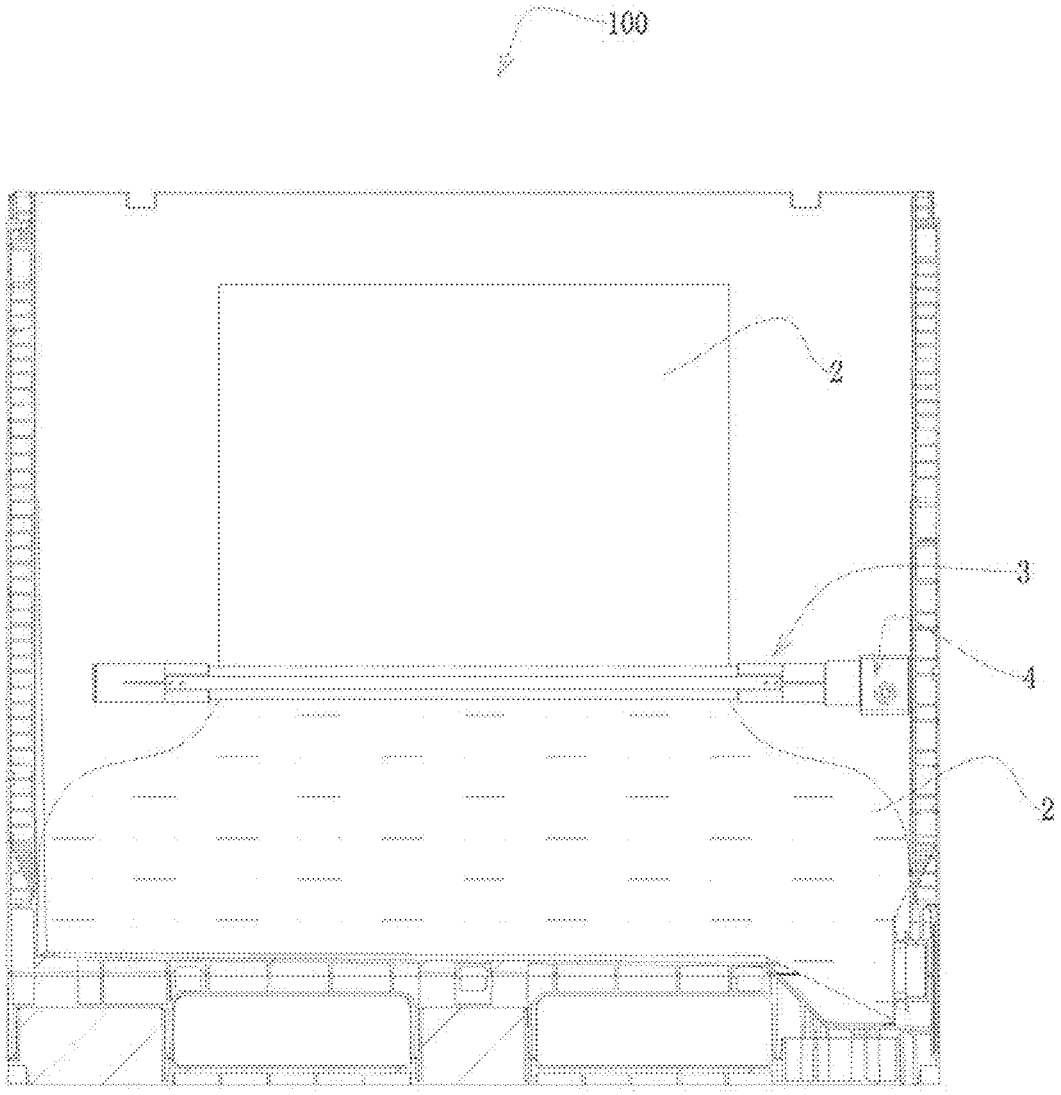
Figure 23:
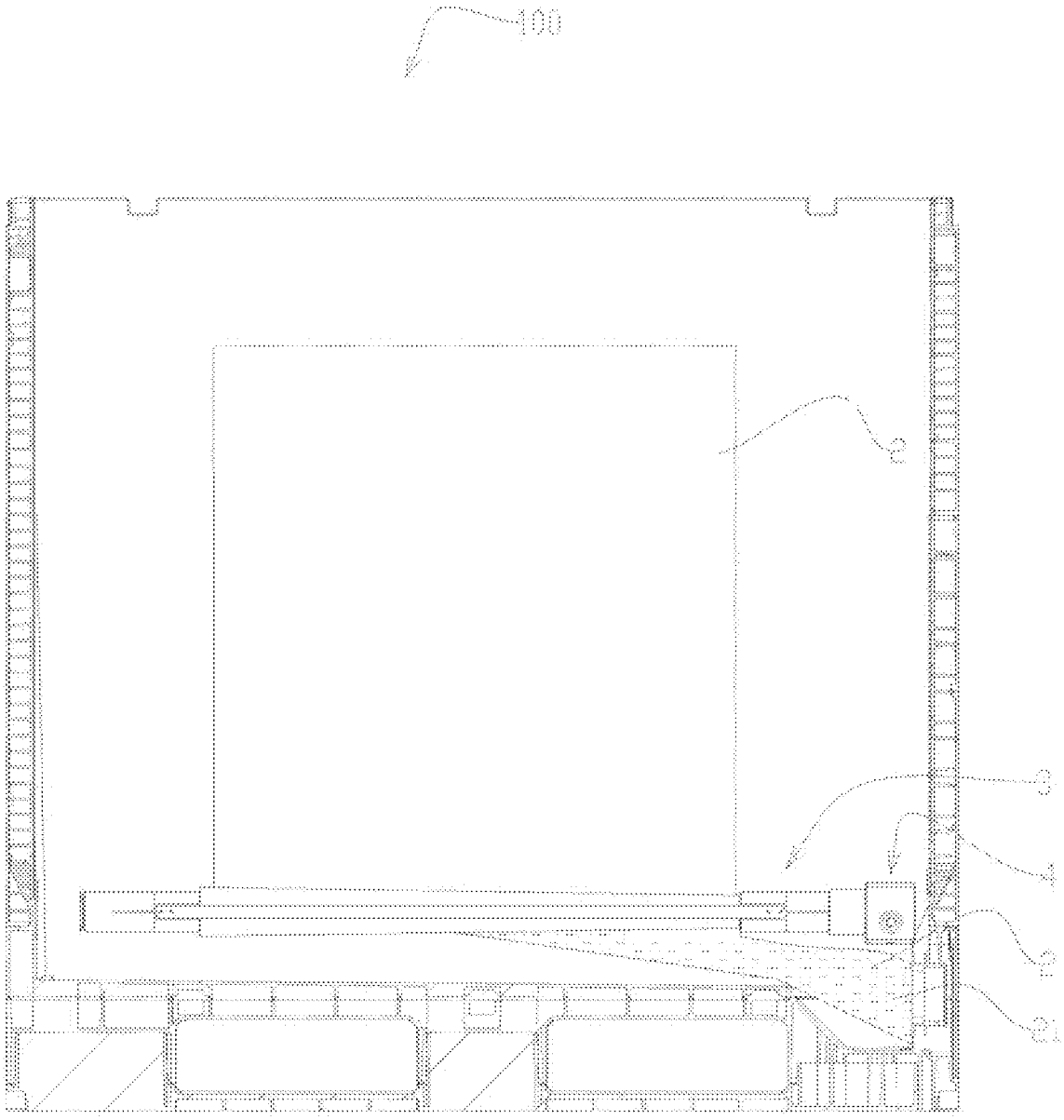

FIG. 16 is a perspective view showing the discharge system of the present invention, and FIGS. 17-20 are cross-sectional views showing the discharge system of the present invention, showing the process of discharging the liquid of the discharge system of the present invention, and FIGS. 21-23 show the discharge system of the present invention, with the sections thereof different from the sections of FIGS. 17-20.

As shown in FIGS. 16-23, when the liquid in the liner bag is discharged, the liner bag is clamped with the first part and the second part of the squeezing device, and the gears on the first part and the gears on the second part engage with each other, and the first part and the second part are connected to each other through a connecting structure (for example, a connecting hole) provided on the first part and a mating connecting structure (for example, a connecting pin) provided on the second part, through the locking structure on the first part (e.g., the locking groove 31B3) and the mating locking structure on the second part (e.g., the locking post 32B3), the first part and the second part are locked with each other, and finally the driving device is connected to the squeezing device, and finally the driving device is activated. By the rotation of the driving shaft of the driving device driving the rolling shaft to rotate, and the gears of the first part and the gears of the second part engaging with each other, the two rolling shafts rotate in opposite directions to squeeze the liquid in the liner bag out. During liquid discharging, as the liquid in the liner bag decreases, the two rolling shafts automatically descend with the descending of the liquid level and squeeze the liquid all the time under the driving of the driving device.

As can be seen from FIGS. 16-23, the entire squeezing device automatically descends as the liquid level in the liner bag decreases, and the liquid in the liner bag is finally discharged through the discharge port completely. Since the rolling shaft always squeezes the liner bag, the liquid in the liner bag is substantially discharged through the discharge port completely, thereby achieving complete discharge of the liquid in the liner bag without residues.

Although in the above embodiment, the squeezing device and the driving device are integrally formed, it should be understood that in another embodiment, the driving device may be integrated in the squeezing device, wherein the driving device may be powered by on board power supply or external power supply.

The Second Embodiment

Next, the second embodiment of this invention is described reference to FIGS. 24-31. The main difference between the second embodiment and the first embodiment is that, in the second embodiment, the rolling shafts of the squeezing device have a taper so that the liquid in the liner bag can be converged toward the discharge port during the squeezing discharge process, thereby speed up the discharge of liquids and discharge liquids more thoroughly. Only the differences between the fluid discharge system of the second embodiment and the fluid discharge system of the first embodiment will be described herein, and the same contents as the first embodiment will not be described in detail herein. Regarding related content, the description of the first embodiment can be referred to.

Figure 24:
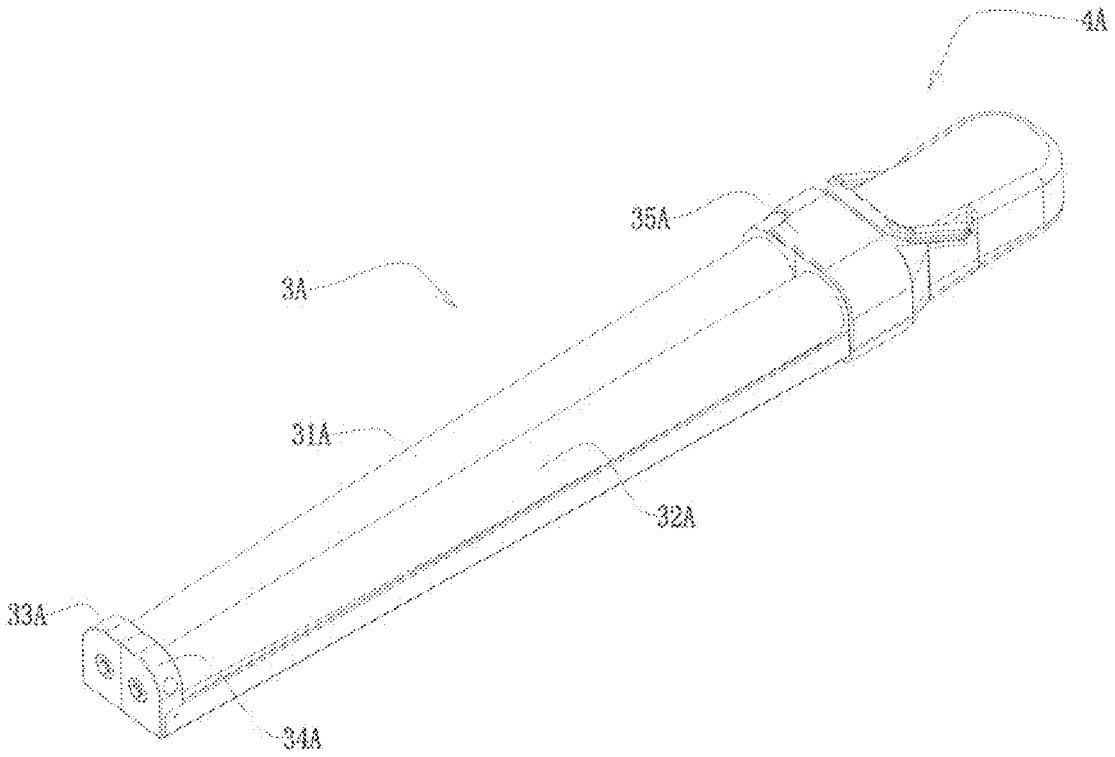
FIG. 24 is the perspective view of the squeezing device according to the second embodiment of this invention.
Figure 25:
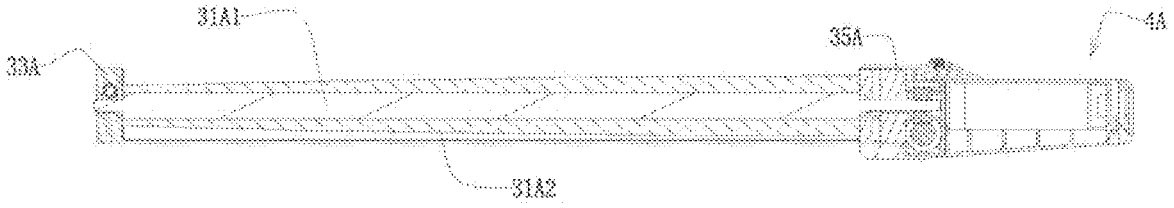
FIG. 25 is the cross-section view of the squeezing device shown in FIG. 24.
Figure 26:
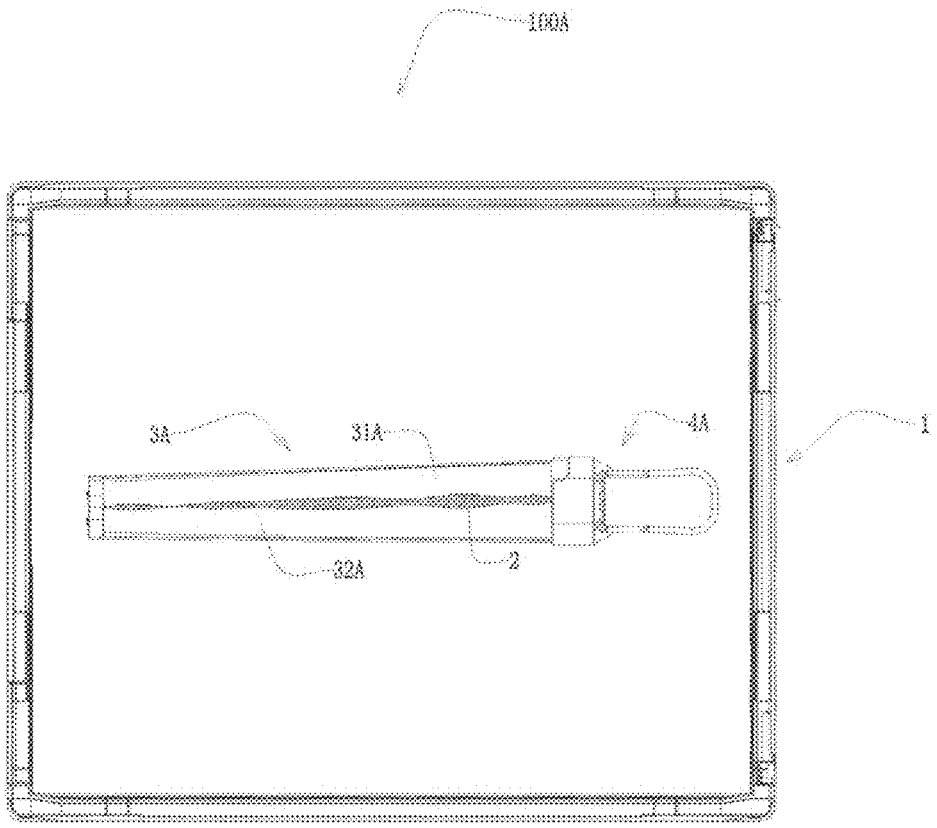
FIG. 26 is the top view of the liquid discharge system according to the second embodiment of this invention.
Figure 27:
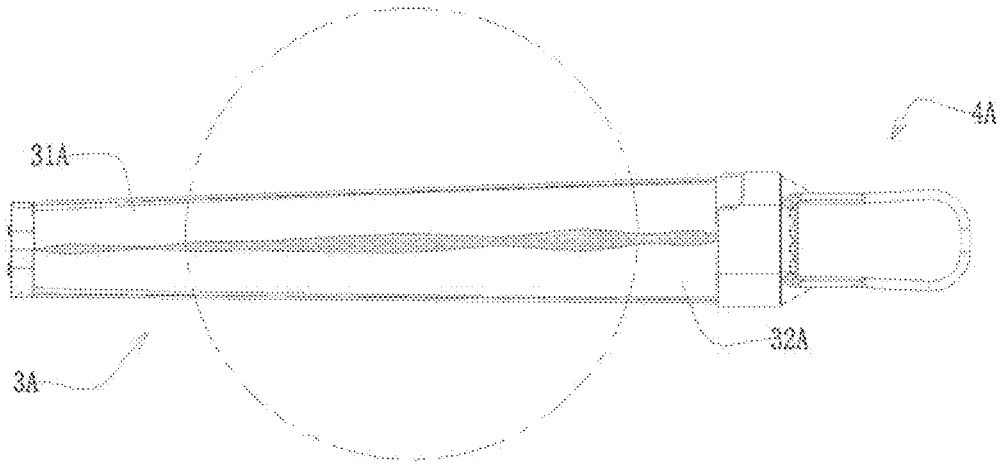
FIG. 27 is the squeezing device in FIG. 26.
Figure 28:
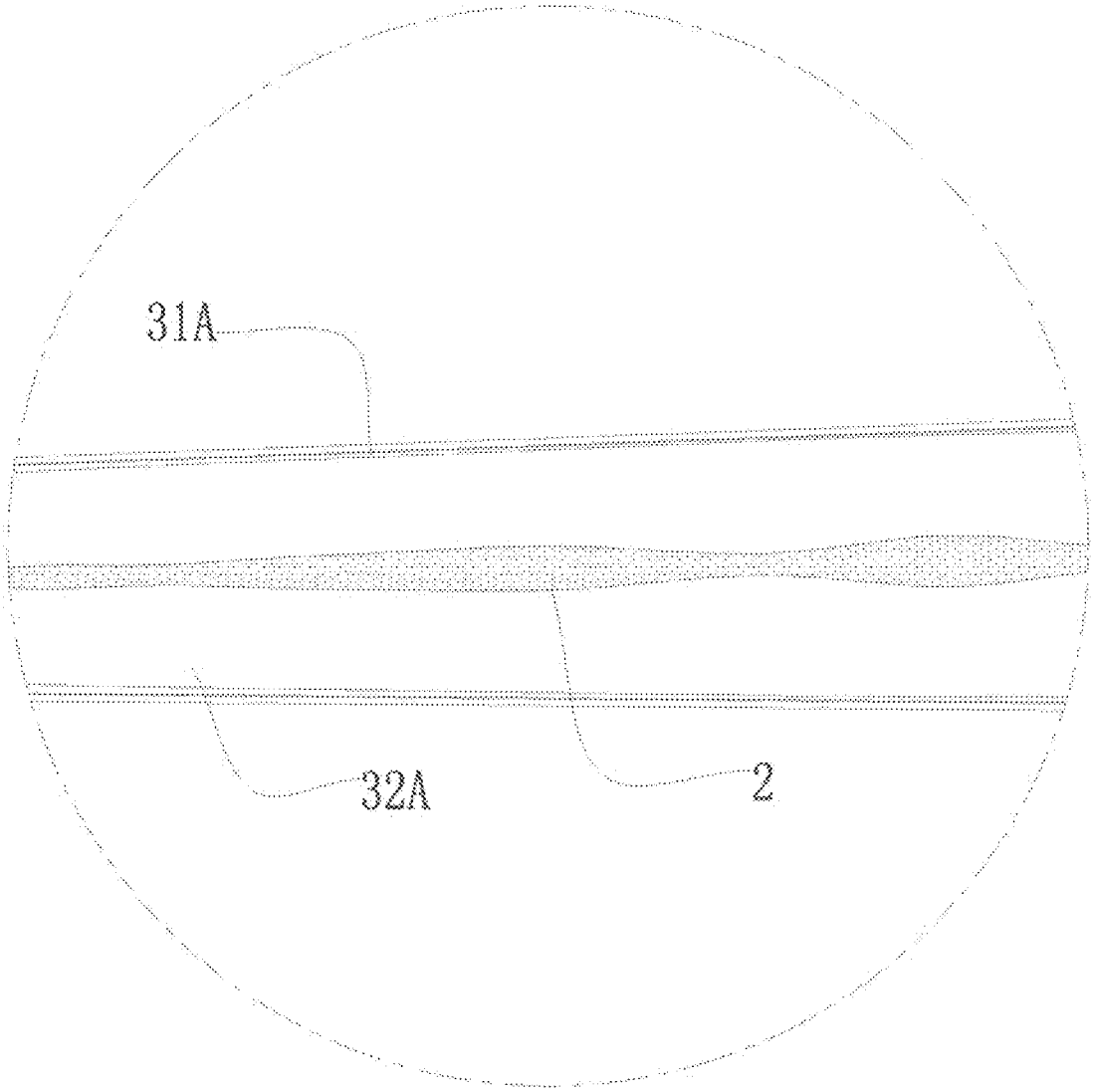
FIG. 28 is the enlarged view of the detail A in FIG. 27.
Figure 29:
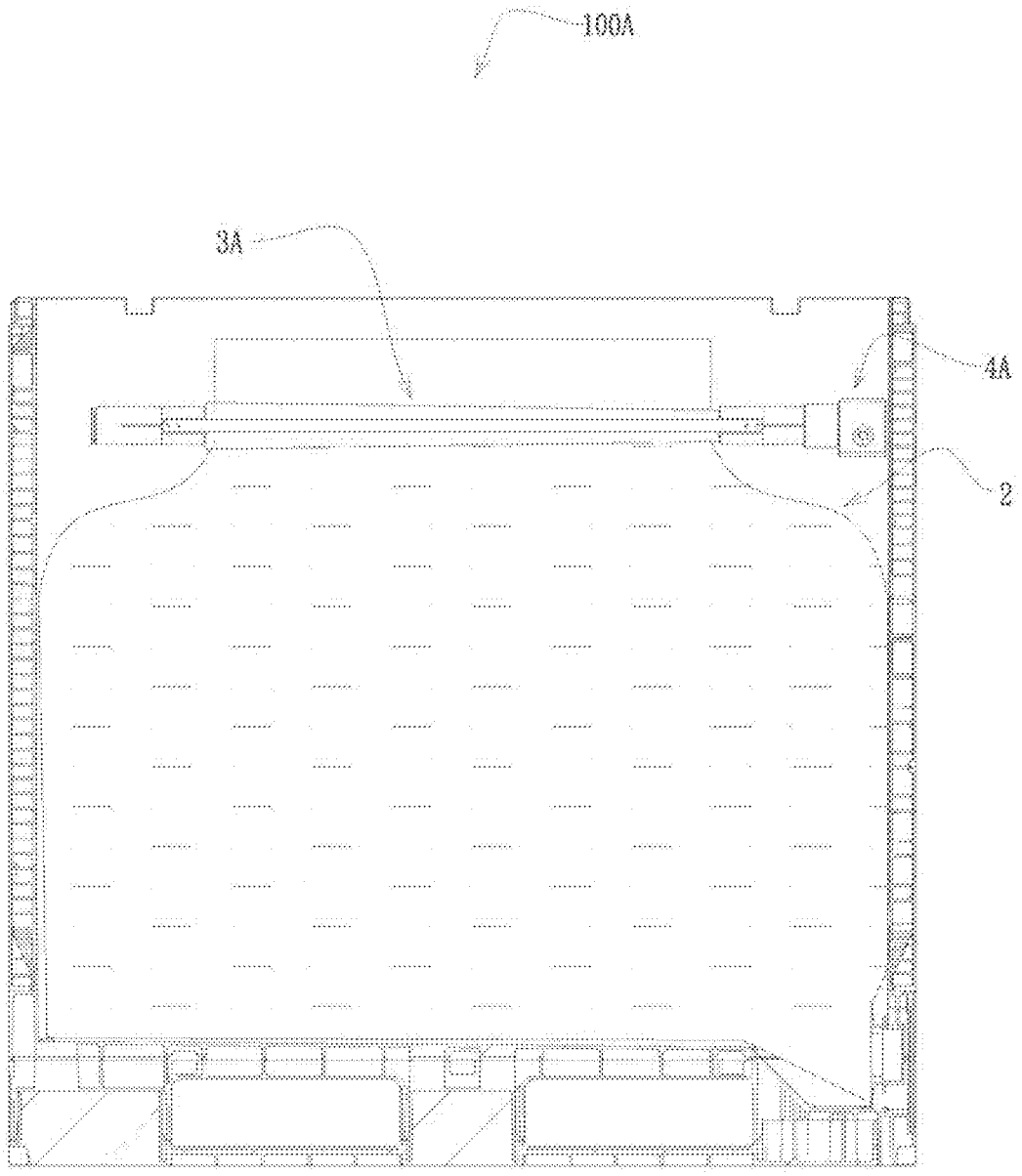
FIGS. 29-31 are the cross-section views of the liquid discharge system according to the second embodiment of this invention, showing the different phases during liquid discharging.
Figure 30:
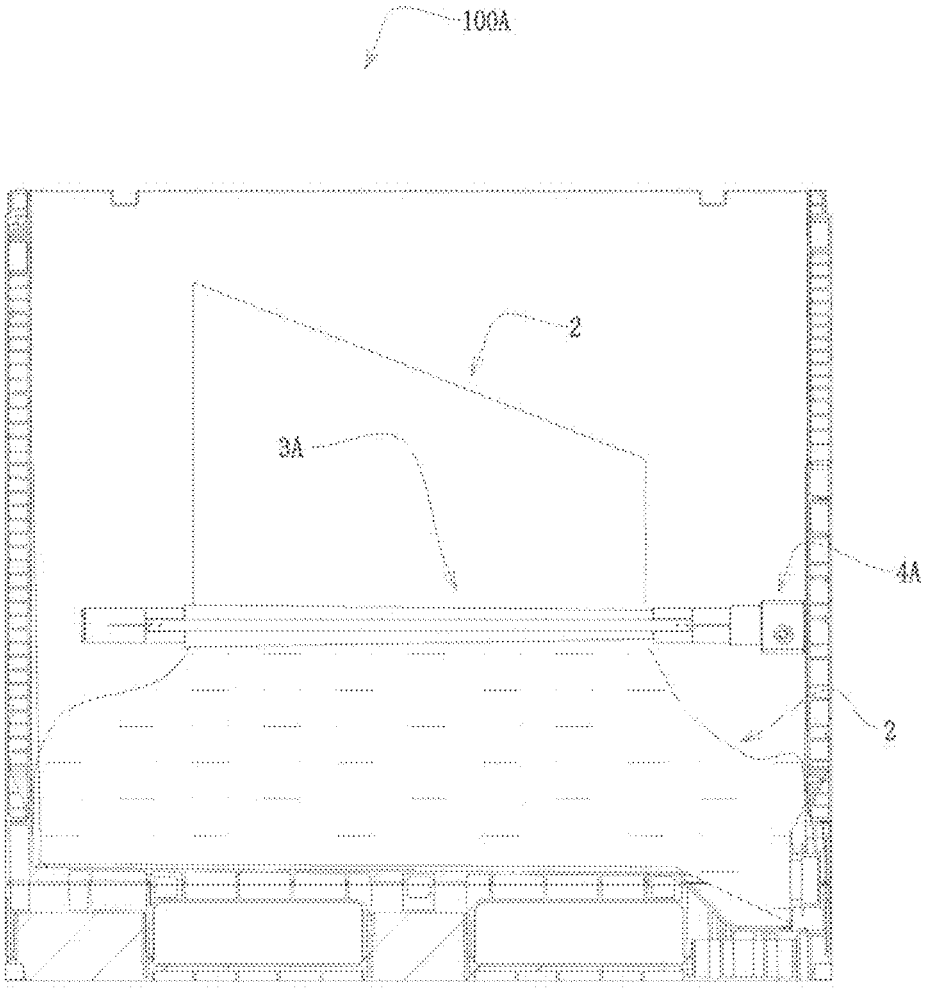
Figure 31:
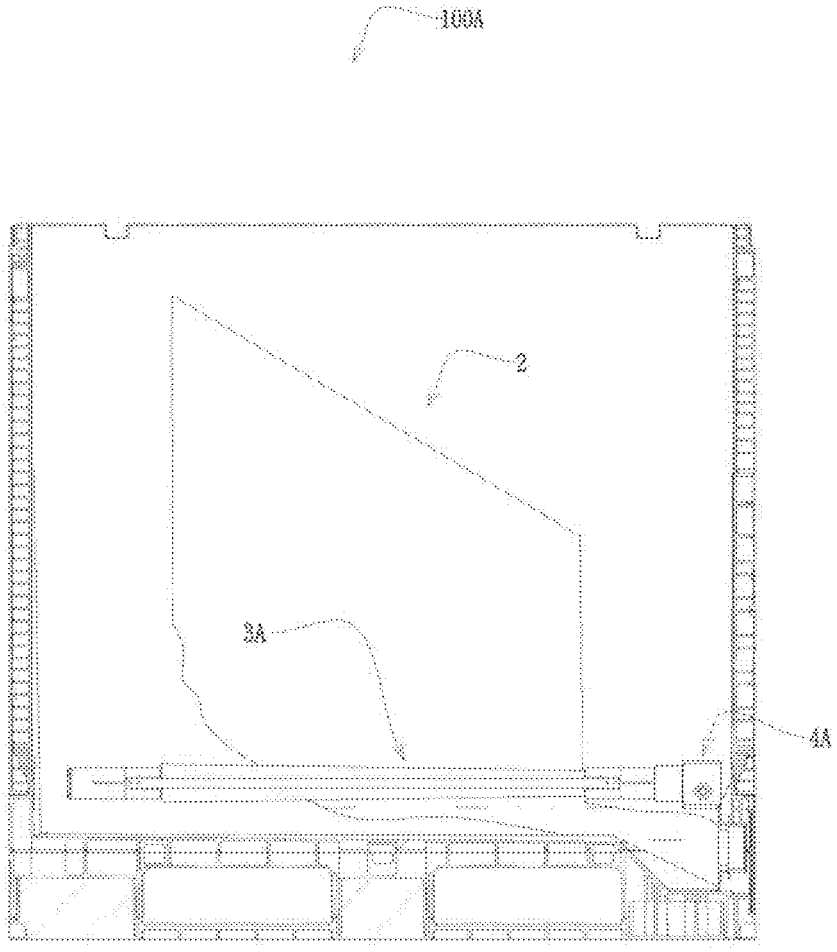

FIG. 24 is a perspective view of the squeezing device of the present embodiment, FIG. 25 is a cross-sectional view of the squeezing device of FIG. 24, FIG. 26 is a plan view of the fluid discharge system 100A of the present embodiment, FIG. 27 is a view of the squeezing device of FIG. 26, FIG. 28 is an enlarged view of a portion A of FIG. 27, and FIGS. 29-31 are cross-sectional views of the fluid discharge system of the present invention, showing different stages of the fluid discharge process.

As shown in FIGS. 24-31, the discharge system 100A of this embodiment includes a container 1, an liner bag 2, an squeezing device 3A, and a driving device 4A. The liner bag 2 is installed in the container 1. The squeezing device 3A includes at least two rolling shafts 31A and 32A, and the driving device 4A is integrated at the end of the squeezing device 3A and is used to power the squeezing device 3A. When it is required to discharge the liquid in the liner bag, the liner bag 2 is clamped by the two rolling shafts 31A and 32A, and under the driving of the driving device 4A, the two rolling shafts 31A, 32A are oppositely rotated, thereby squeeze the liquid in the liner bag 2 out. During the liquid discharging, with the reducing of the liquid in the liner bag 2, the two rolling shafts 31A, 32A automatically descend as the liquid level decreases under the driving of the driving device 4A and squeeze the liquid in the liner bag 2 by opposite rotation thereof.

As shown in FIG. 25, the rolling shaft 31A includes a supporting rod 31A1 and an elastic soft body 31A2 which is disposed around the support shaft 31A1, wherein the supporting rod 31A1 is substantially cylindrical, that is, the outer diameter thereof substantially does not vary in the axial direction, and the outer diameter of the elastic soft body 31A1 uniformly varies in the axial direction to form a tapered elastic soft body.

As shown in FIGS. 24-31, during the squeezing discharge of the liquid in the liner bag 2, the elastic soft body outside the rolling shaft will elastically vary with the amount of liquid in the liner bag and the thickness of the part between the two layers of the liner bags, so that the elastic soft body can absorb the uneven thickness of the liner bag during the squeezing process, that is, the elastic soft body is elastically deformed where the liner bag is thick. The rolling shafts always exert opposite squeezing forces on the liner bag, and where the liner bag is thin, the elastic soft body also fits the liner bag so that the liner bag is exerted with opposite squeezing forces. In this way, during discharging, the liner bag is clamped by the squeezing device. Each part, regardless of the thickness thereof, is always exerted with the opposite squeezing forces of the rolling shafts along the length of the rolling shaft, and the liquid in the liner bag is always squeezed to the discharge port, so as to achieve complete discharge of the liquid in the liner bag without residues.

In addition, since the rolling shafts have a taper, in the squeezing discharge process, the thinner end of the rolling shaft is placed above the discharge port of the liner bag, and the thicker end of the roller is placed above the other end of the liner bag which is opposite to the discharge port, in the process of squeezing discharge the liquid in the liner bag, the thicker end of the rolling shaft has a larger linear velocity, and therefore, the rolling distance thereof is longer than that of the thinner end of the rolling shaft, so that the liquid in the liner bag is converged to the discharge port of the liner bag, thereby accelerating the discharge speed of the liquid in the liner bag, and achieving complete discharge of the liquid in the liner bag without residues.

Although in the present embodiment, the elastic soft body is uniformly changed from one end to the other end to form an elastic soft body having the same taper, it will be understood by those skilled in the art that each of the rolling shafts may also include two taper segments with outer diameters thereof uniformly changing, or each rolling shaft may include a plurality of tapered segments (e.g., three tapered segments) with outer diameters thereof uniformly changing.

The Third Embodiment

Figure 32:
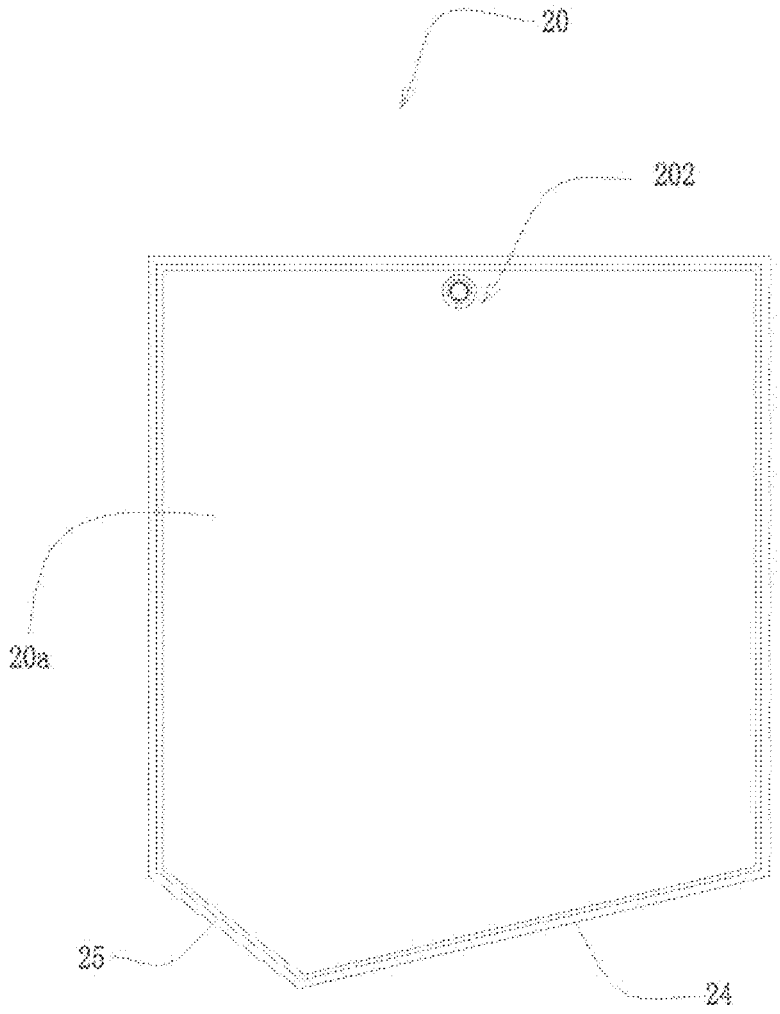
FIGS. 32-33 are the plan views of the liner bag according to the third embodiment of this invention.
Figure 33:
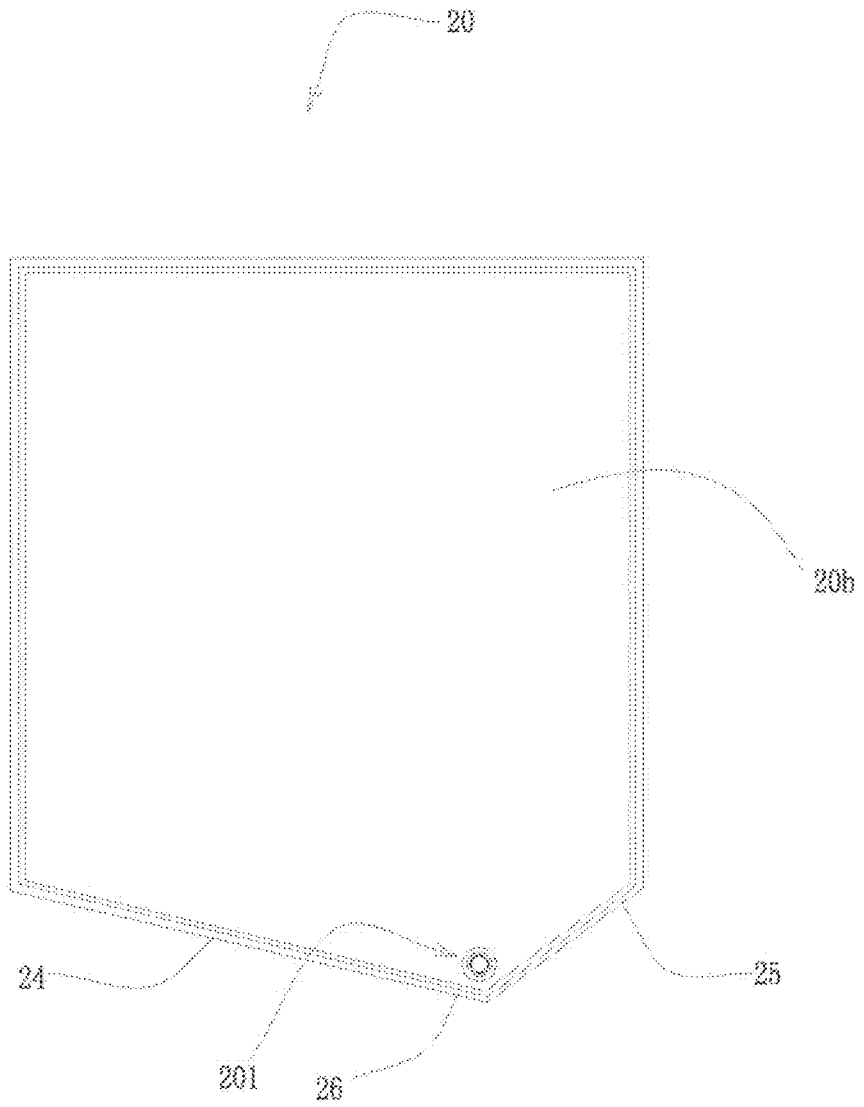

Next, the third embodiment of this invention is described reference to FIGS. 32-33. The difference between the third embodiment and the first embodiment as well as the second embodiment is that the liner bag is provided with a flow guiding structure thereon. The other parts are identical to the first embodiment or identical to the third embodiment.

FIGS. 32-33 show the two surfaces of the liner bag of this embodiment, respectively. As shown in FIGS. 32-33, the liner bag 20 of the present embodiment is formed by welding a front panel 20*a* and a rear panel 20*b* to each other at the edge portions thereof, and the discharge port 201 is provided on the front panel 20*a* or the rear panel 20*b* and adjacent to the weld line 26 at the bottom of the liner bag 20. In this embodiment, the discharge port 201 is welded to the rear panel 20*b*, and a filling port 202 is welded to the upper portion of the front panel 20*a*, and the filling port 202 is used to fill liquid (usually a viscous liquid with a viscosity of more than 300,000 CPS). The discharge port 201 is used to discharge liquid (usually a viscous liquid with a viscosity greater than 300,000 CPS).

As shown in FIGS. 32-33, in this embodiment, the bottom portions of both the front panel 20*a* and the rear panel 20*b* is formed with mutually cooperating flow guiding structures 24 and 25, and in this embodiment, the flow guiding structures 24 and 25 are both inclined face inclining toward the discharge port 201, the specific angle of the inclined face can be set as needed Although in this embodiment, the bottom portions of the front panel 20*a* and the rear panel 20*b* of the liner bag 20 are provided with two inclined faces 24, 25 respectively, it will be understood by those skilled in the art that the bottom of the liner bag may also be formed with a plurality of inclined faces, such as three, four, and five inclined faces, the plurality of inclined faces are formed to be connected to each other end to end and incline toward the discharge port, so that the liquid in the liner bag can be converged along the plurality of inclined faces during discharging.

When the liquid in the liner bag discharging, the two rolling shafts automatically descend with the liquid level under the driving of the driving device and squeeze the liquid all the time, and the liquid can convergently flow to the discharge port 201 along the flow guiding structures 24 and 25, thereby draining the liquid in the liner bag through the discharge port 201 more thoroughly.

In this embodiment, since the liner bag is formed by hermetically sealing the front panel and the rear panel, the discharge port is disposed adjacent the weld line adjacent to the liner bag, and the bottom of the liner bag is provided with a flow guiding structure, when the liquid is filled in the bag, the discharge port is located substantially at the center line (weld line) of the bottom of the liner bag, that is, the liner bag is substantially axially symmetric about the discharge port, and the liquid can be converged to the discharge port through the flow guiding structure, thereby during the liquid discharging, the liquid can be discharged from the liner bag through the discharge port more thoroughly.

The flow guiding structure of the liner bag of the present invention may have various modifications as long as the fluid can flow to the discharge port in a converged manner to achieve the object of the present invention. It should be understood by those skilled in the art that the liner bag of the third embodiment can be used for both the first embodiment and the second embodiment. When it is used in the second embodiment, by the coordination of the flow guiding structure and the tapered rolling shaft, the liquid in the liner bag can be convergently discharged to the discharge port more efficiently, and can be discharged from the liner bag via the discharge port.

Although in the above embodiments, the squeezing bracket of the squeezing device has been described in detail, those skilled in the art will appreciate that other forms of squeezing brackets can also be used in the present invention. The main character of the present invention is that, firstly, the squeezing device does not need to be suspended, that is, the two rolling shafts of the squeezing device can automatically move downward with the falling of the liquid level in the liner bag, so that the liquid in the liner bag is always squeezed off; secondly, the outside of the rolling shaft is wrapped with elastic soft body, in the squeezing discharge process, the elastic soft body of the rolling shaft can elastically deform with the increase or decrease of the liquid in the liner bag, and keep in contact with the liner bag. Therefore, the various segments of the liner bag are subjected to the squeezing force to achieve zero residue of the liquid; thirdly, the rolling shaft can be a tapered rolling shaft, thereby converging the liquid to the discharge port and discharging the liquid off the liner bag through the discharge port; and finally, the bottom of the liner bag can also be provided with a flow guiding structure to discharge the liquid in the liner bag to the discharge port. It should be understood that the tapered rolling shaft and the flow guiding structure of the present invention are all for the same purpose, that is, the liquid in the liner bag is converged to the discharge port and discharged off the liner bag through the discharge port.

Further, although in the above embodiment, the elastic soft body is an integral part and wraps most of the supporting rod, it will be understood by those skilled in the art that the elastic soft body may only wrap a small portion of the supporting rod. The object of the invention can also be achieved to a certain extent. And although in the above embodiments, the squeezing device comprises only two rolling shafts, that is, the first part and the second part of the squeezing device each comprise only one rolling shaft, however, those skilled in the art will appreciate that the first part and the second part of the squeezing device each may also include a plurality of rolling shafts, for example, three, four, or five rolling shafts, etc., in this case, the plurality of rolling shafts may be connected to each other to form a whole, and cooperate with the rolling shaft of another part of the squeezing device. In addition, in the above embodiment, the two rolling shafts rotate in opposite directions, however, only one rolling shaft can also achieve the squeezing effect. In addition, the opposite rotation of the two rolling shafts can be either synchronous or asynchronous. And, the container of the present invention may be a common container or a collapsible container. The squeezing device can be placed outside the container as an independent component. When it is needed to discharge the liquid, the squeezing device and the driving device are installed into the container body, and sliding rails can also be provided on the inner wall of the side plate for installing the driving device on the sliding rails. When the driving device is connected with the squeezing device to squeeze the liquid, the driving device can slide down along the sliding rails as the liquid level drops.

Figure 35:
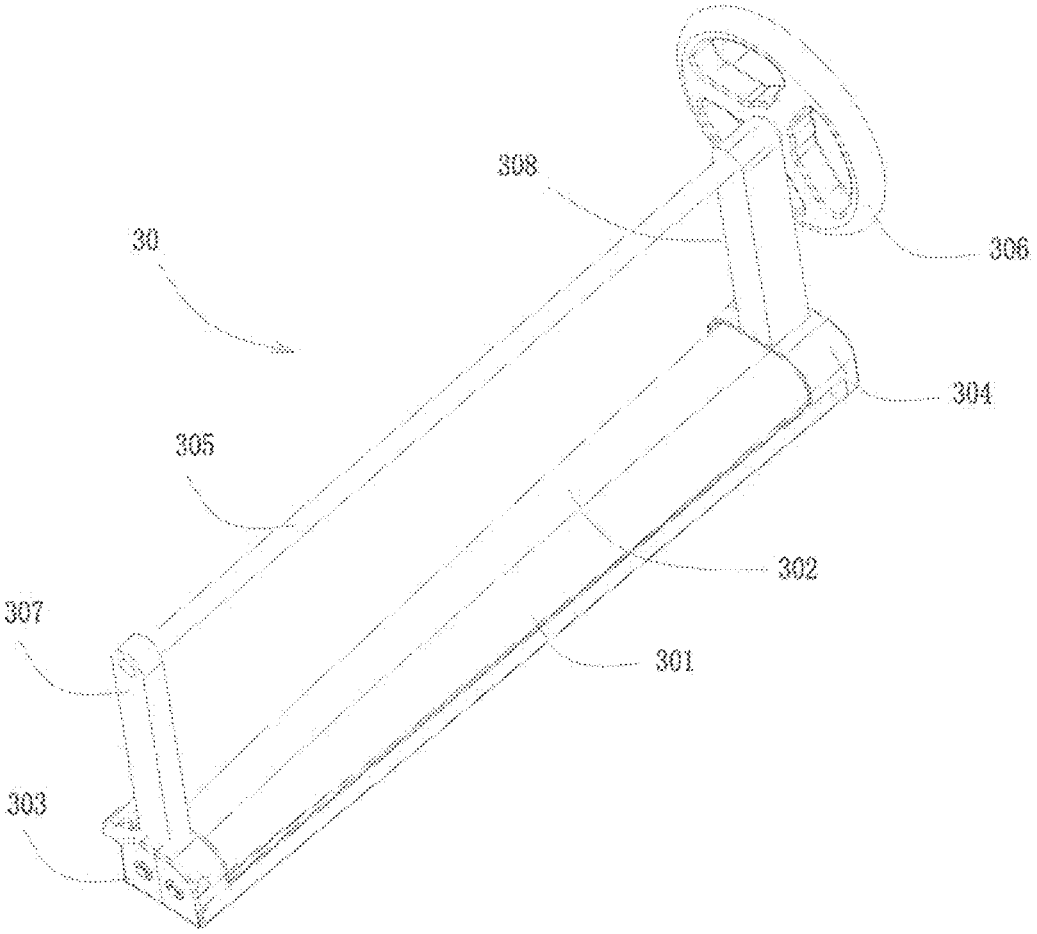
FIG. 35 is a structure view of the squeezing device according to one embodiment of this invention.
Figure 36:
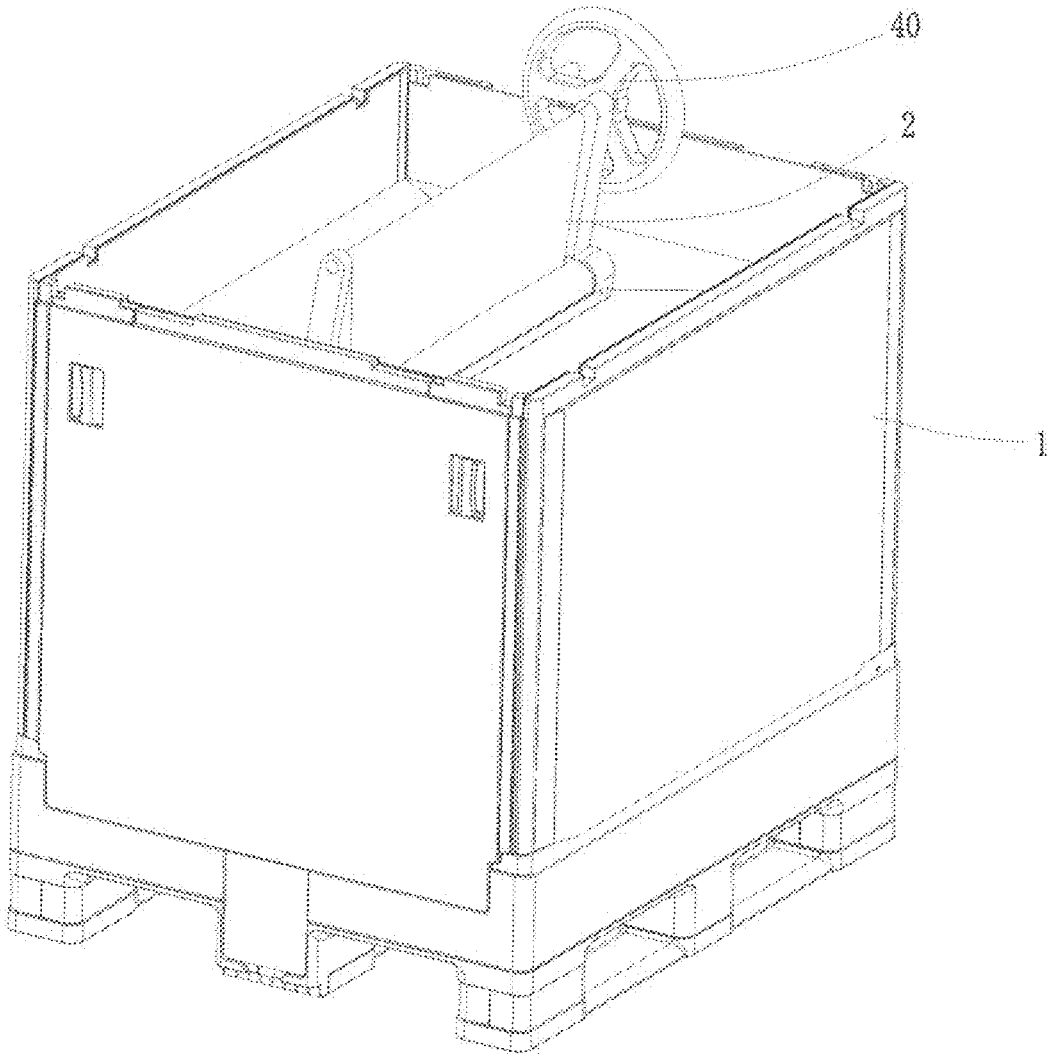
FIG. 36 is the perspective view of the squeezer in FIG. 35 in use.
Figure 37:
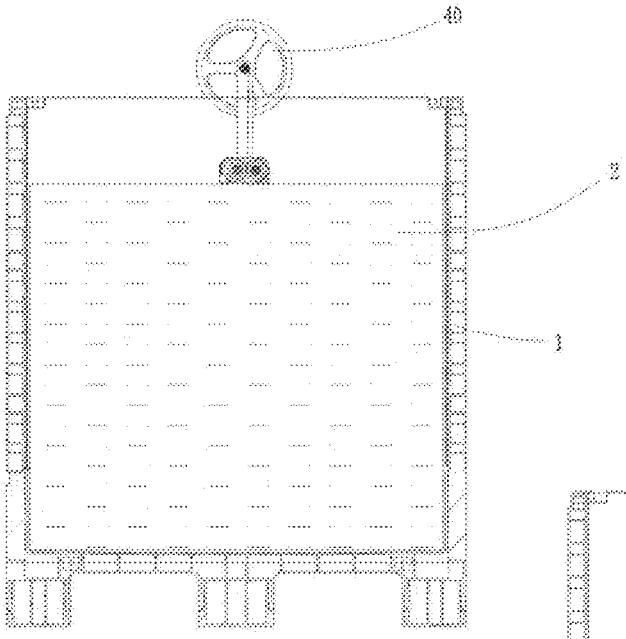
FIGS. 37-40 show the process of assisting in liquid discharging by the squeezer in FIG. 35.
Figure 38:
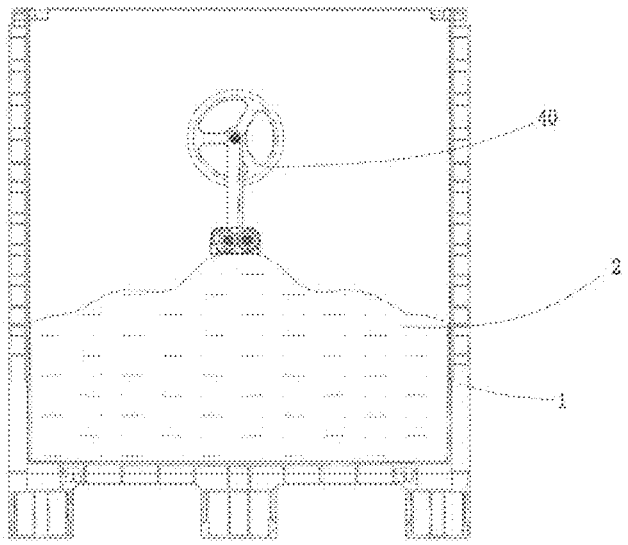
Figure 39:
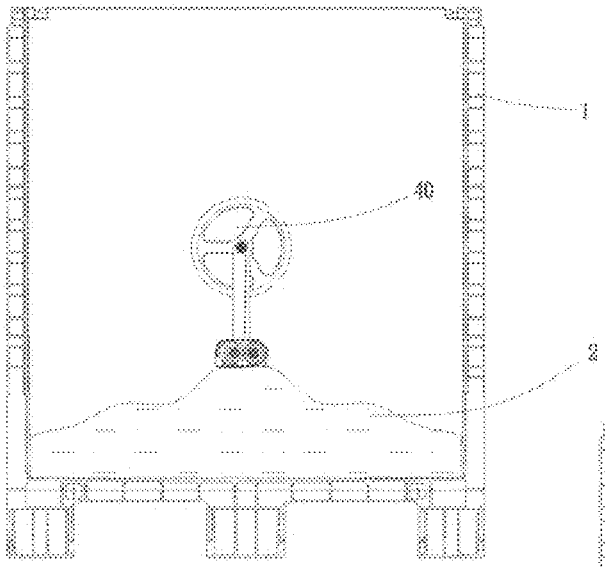
Figure 40:
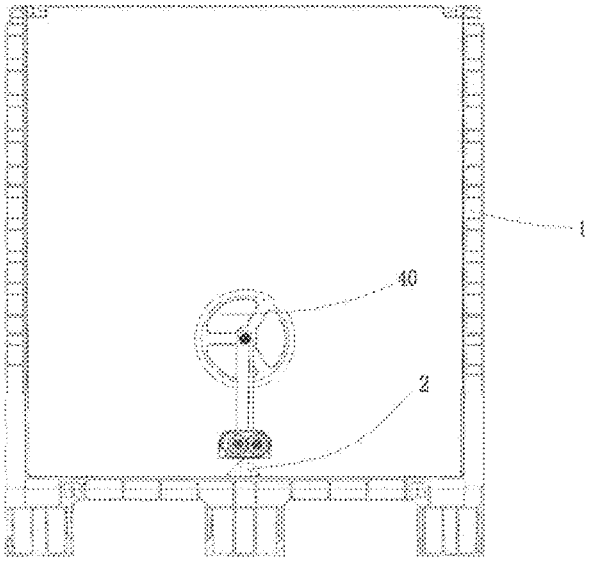

FIG. 35 is a schematic view of the squeezing device 40 according to yet another embodiment of this invention. As shown in FIG. 35, the squeezer includes two squeezing members 301 and 302. The squeezing members 301 and 302 are rolling shafts. The first ends of the squeezing members 301 and 302 are rotatably mounted to the first mounting bracket 303, and the second ends are rotatably mounted to the second mounting bracket 304. The first mounting bracket 303 and the second mounting bracket 304 each include two separable mounting heads, and the ends of the squeezing members 301 and 302 are mounted on the corresponding mounting heads respectively. Thereby, the squeezing members 301 and 302 can be separated, thereby facilitating the operation of clamping the liner bag. Herein, the rolling shaft may employ a structure similar to that of the rolling shaft in the above embodiment, and will not be described in detail herein.

A supporting rod 307 and a supporting rod 308 are further connected to the first mounting bracket 303 and the second mounting bracket 304 respectively. Two ends of the rotating shaft 305 are rotatably connected to the supporting rods 307 and 308 respectively. A hand wheel 306 is also connected to one end of the rotating shaft 35. The rotation of the hand wheel 306 can drive the rotating shaft 305 to rotate. Herein, the hand wheel and the rotating shaft 305 are used as a driving device for the squeezer 40. Different from the above embodiment, the driving device of the embodiment is used to drive the liner bag instead of the rolling shaft.

FIGS. 36 to 40 show a process diagram in which an squeezer 40 is employed to discharge the liquid in an liner bag in an intermediate bulk container. As shown in FIGS. 36-40, during liquid discharging, it is necessary to pass the top of the liner bag 2 in the intermediate bulk container 1 through the gap between the two rolling shafts 301 and 302. Next, the top of the liner bag 2 will be wound around the rotating shaft 305. Then, the hand wheel 306 is rotated. The rotation of the hand wheel 306 drives the rotating shaft 305 to rotate. The rotation of the rotating shaft 305 winds the liner bag around the rotating shaft 305, while the rolling shafts 301 and 302 apply a squeezing force to the liner bag (and the liquid therein), and the liquid moves downwardly to be discharged. While the liquid is being discharged, the squeezer 40 automatically descend as the liquid level in the liner bag decreases. Thus, as the hand wheel 306 is continuously rotated, the liner bag is continuously wound onto the rotating shaft 305, and the liquid level in the liner bag continuously decreases, and the squeezer 40 continuously descends as the liquid level decreases until the liquid is completely discharged. Due to the squeezing force suffered by the liner bag during discharging of the liquid in the liner bag, the squeezing force will scrape the viscous liquid adhered to the inner wall of the liner bag downwardly, thereby reducing the liquid residue in the liner bag.

It should be noted that the squeezer 40 shown in FIGS. 35-40 can descend with the decreasing of the liquid level in the liner bag mainly because the squeezer 10 is freely move relative to the container 1 and is associated with an liner bag. It should be understood that the supporting rod between the rotating shaft 305 and the mounting bracket can also be eliminated, and the same effect can be achieved. Then, the squeezing device and the driving device of the squeezer are separated.

Figure 41:
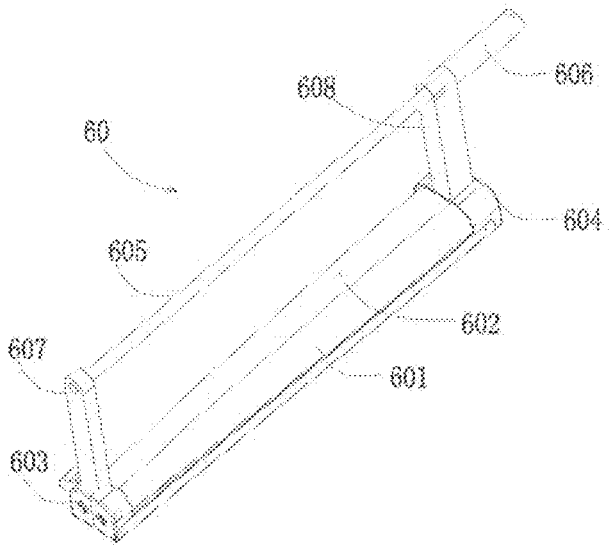
FIG. 41 is a variant of squeezer in FIG. 35, which is different from the squeezer in FIG. 35 in the driving device, the driving device in FIG. 25 is manual, while the driving device in FIG. 41 is automotive.

FIG. 41 is a variant of the squeezer of FIG. 35. The squeezer 60 shown in FIG. 41 differs from that shown in FIG. 35 mainly in the driving device. The driving device of FIG. 35 is manual while the driving device of FIG. 41 is automatic. Specifically, the squeezer 60 includes two squeezing members 601 and 602. The squeezing members 601 and 602 are rolling shafts. The first ends of the squeezing members 601 and 602 are rotatably mounted to the first mounting bracket 603, and the second ends are rotatably mounted to the second mounting bracket 604. The first mounting bracket 603 and the second mounting bracket 604 each include two separable mounting heads, and the ends of the squeezing members 601 and 602 are mounted on the corresponding mounting heads respectively. Thereby, the squeezing members 601 and 602 can be separated, thereby facilitating the operation of clamping the liner bag. Herein, the rolling shaft may employ a structure similar to that of the rolling shaft in the above embodiment, and will not be described in detail herein.

Figure 42:
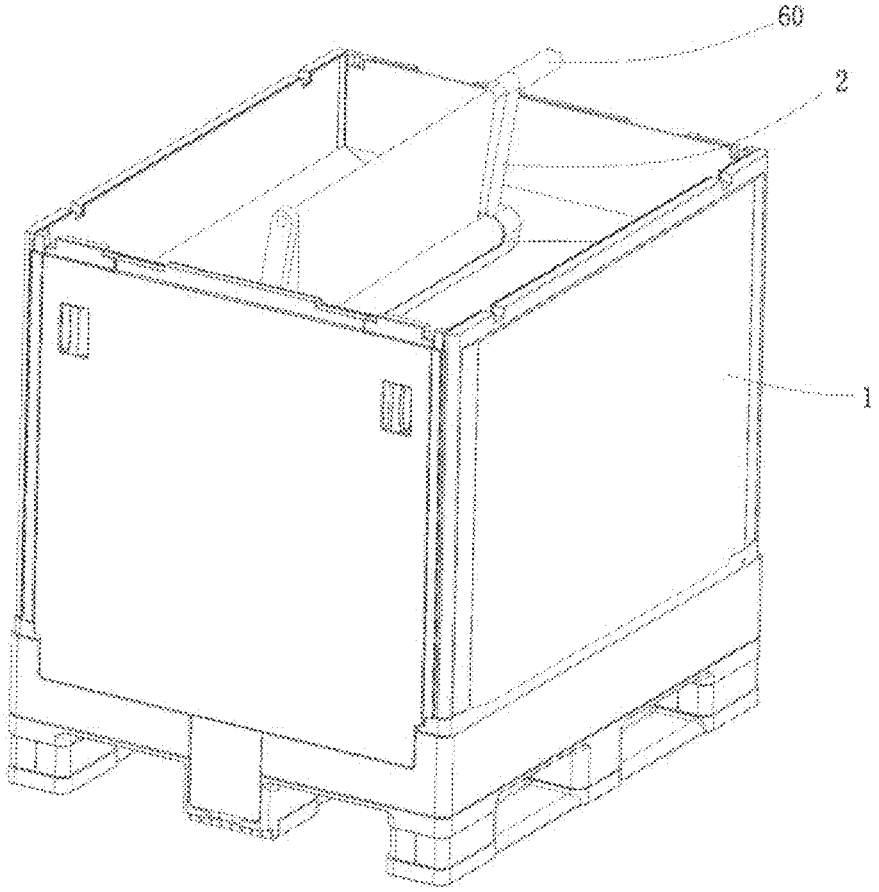
FIG. 42 is the perspective view of the squeezer in FIG. 41 in use.

A supporting rod 607 and a supporting rod 608 are further connected to the first mounting bracket 603 and the second mounting bracket 304 respectively. Two ends of the rotating shaft 605 are rotatably connected to the supporting rods 607 and 608 respectively. A motor 606 is also connected to one end of the rotating shaft 35. The rotation of the motor 606 can drive the rotating shaft 605 to rotate. Herein, the motor and the rotating shaft are used as a driving device for the squeezer 60. Different from the embodiment shown in FIG. 35, the driving device of the embodiment is also used to drive the liner bag instead of the rolling shaft. As shown in FIG. 42, the operation of the squeezer 60 of the present embodiment is basically the same as that of the embodiment shown in FIG. 35, except that one is manually rotated by the hand wheel and the other is automatically rotated by the motor, which will not be described in detail here.

Figure 43:
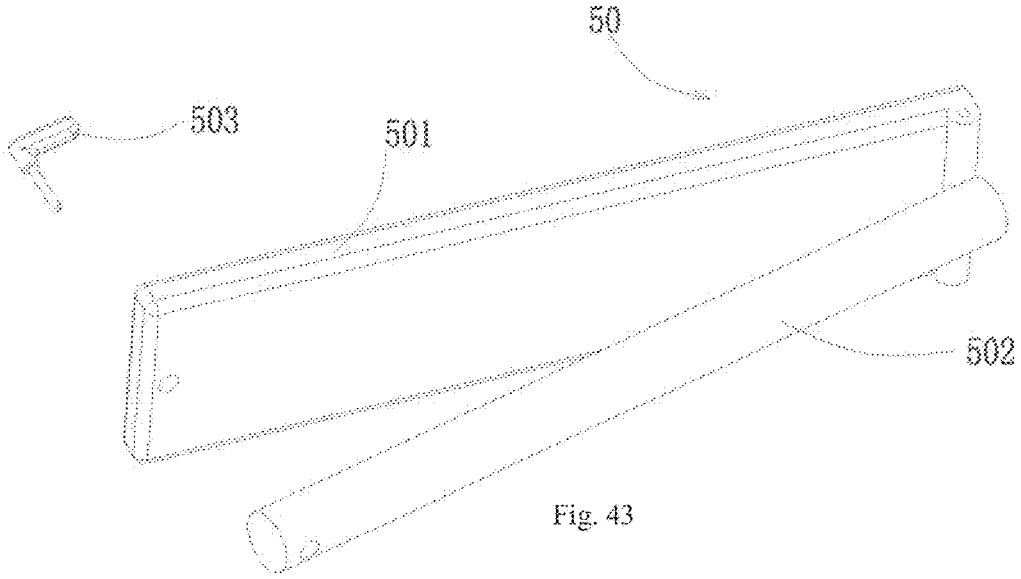
FIGS. 43 and 44 are the structure views of the squeezing device according to the third embodiment of this invention, wherein the squeezing device in FIG. 43 is in open state, while the squeezing device in FIG. 44 is in clamping state.
Figure 44:
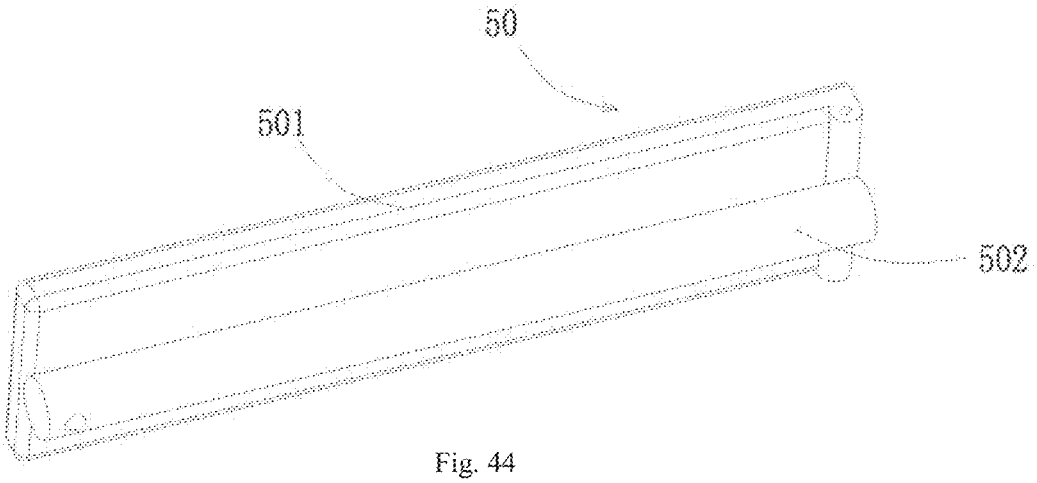

FIGS. 43 and 44 are schematic views showing the structure of the squeezing device 50 according to an embodiment of the present invention, wherein the squeezing device 50 of FIG. 43 is in an opening state, and the squeezing device 50 of FIG. 44 is in a clamping state. The squeezing device of FIGS. 43 and 44 can be used with the driving device of FIGS. 35 and 41, and will not be described in detail herein. As shown in FIGS. 43 and 44, the squeezing device 50 is provided with a squeezing plate 501 and a rolling shaft 502.

One end of the rolling shaft 502 is hinged to one end of the squeezing plate 501, and the other end of the rolling shaft 502 is detachably connected to the other end of the squeezing plate 501. Specifically, the other end of the rolling shaft 502 is connected to the other end of the squeezing plate 501 by a detachable locking screw 503. When working, the locking screw 503 can be loosened, the liner bag is placed between the squeezing plate and the rolling shaft, and then the rolling shaft is locked, so that the liner bag is clamped between the squeezing plate and the rolling shaft.

Figure 45:
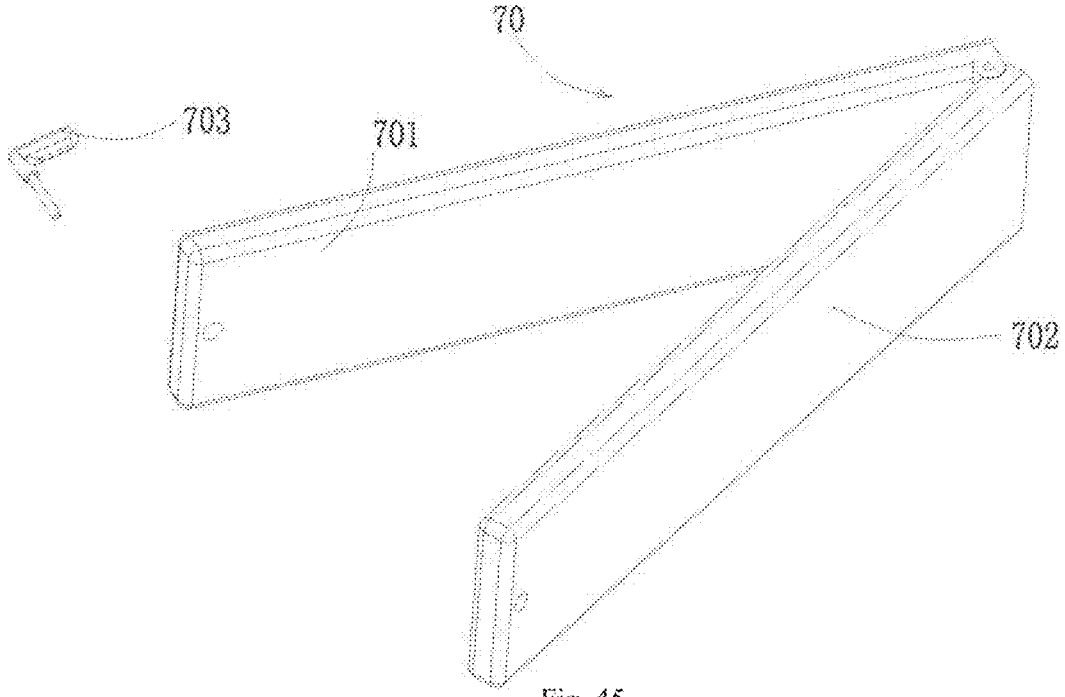
FIGS. 45 and 46 are the structure views of the squeezing device according to the fourth embodiment of this invention, wherein the squeezing device in FIG. 45 is in open state, while the squeezing device in FIG. 46 is in clamping state.
Figure 46:
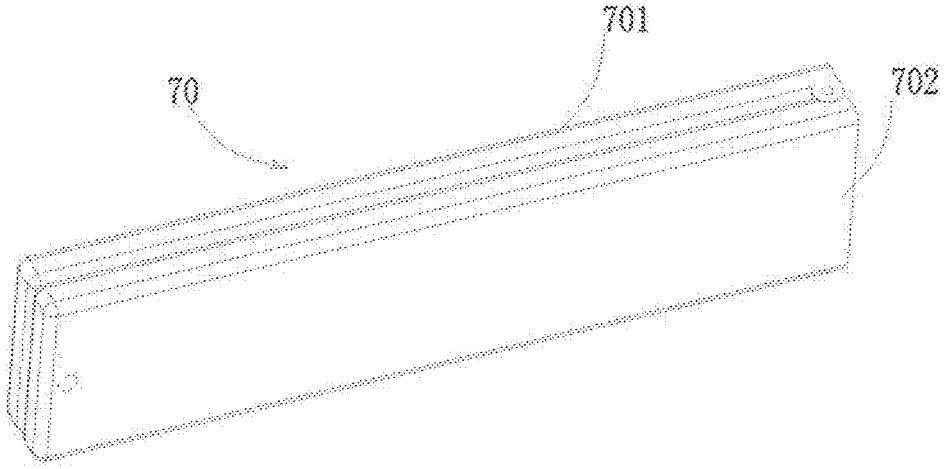

FIGS. 45 and 46 are views showing the structure of the squeezing device 70 according to an embodiment of the present invention, wherein the squeezing device 70 of FIG. 45 is in an opening state, and the squeezing device 70 of FIG. 46 is in a clamping state. The squeezing device of FIGS. 45 and 46 can be used with the driving device of FIGS. 35 and 41, and will not be described in detail herein. As shown in FIGS. 45 and 46, the squeezing device 70 is provided with a first squeezing plate 701 and a second squeezing plate 702. One end of the second squeezing plate 702 is hinged to one end of the squeezing plate 701, and the other end of the second squeezing plate 702 is detachably connected to the other end of the squeezing plate 701. Specifically, the other end of the second squeezing plate 702 is connected to the other end of the squeezing plate 701 by a detachable locking screw 703. When working, the locking screw 703 can be loosened, the liner bag is placed between the squeezing plate and the second squeezing plate, and then the rolling shaft is locked, so that the liner bag is clamped between the squeezing plate and the second squeezing plate.

It should be understood that, under the above principle, the driving device can also adopt other structural forms, which are not enumerated here. Similarly, the driving device can be manual, pneumatical or electrical, and will not be enumerated here.

The preferred embodiments of the present invention have been described in detail above, but it should be understood that those skilled in the art can make various changes or modifications of the present invention after reading the above teachings of the present invention. These equivalent forms also fall within the scope defined by the claims appended hereto.

The invention claimed is:

1. A squeezer, wherein the squeezer includes a pair of squeezing members and a driving device, the driving device including a motor, wherein the pair of squeezing members are configured to operatively clamp an object to be clamped therebetween and while the squeezing members and the clamped object are relatively moving, the pair of squeezing members apply a squeezing force to the clamped object, and the driving device is associated with the pair of squeezing members and at least capable of driving one of the pair of squeezing members to move relative to the other, wherein the clamped object is used to contain liquid, the pair of squeezing members are further configured to be capable of applying a preclamping force to the clamped object when the clamped object is clamped by the squeezer, the pair of squeezing members and the driving device are configured to be able to descend automatically as the liquid in the clamped object decreases, wherein the squeezer is configured to move freely along the clamped object, the pair of squeezing members are a pair of rolling shafts, and each of the rolling shafts includes an elastic soft body and a supporting rod, the elastic soft body is disposed around the supporting rod, and the pair of rolling shafts are disposed to be able to descend as the liquid in a liner bag decreases while rotating in opposite directions, wherein the squeezer comprises a squeezing device and the driving device, wherein the squeezing device is composed of a first part and a second part, each part including the rolling shaft, a squeezing bracket and a gear, an end of each of the rolling shafts respectively installed in one of two squeezing brackets, and at least one end of the rolling shaft is provided with a gear, which is mounted around a portion of the rolling shaft that is located in the squeezing bracket, and the first part and the second part clamp a liner bag and are fixed by cooperation of the squeezing brackets at two ends of each rolling shaft, and the supporting rod includes a first segment, a second segment, a third segment and a driving shaft, the outer diameter of the first segment is less than that of the second segment, the outer diameter of the second segment is less than that of the third segment, wherein the gear is installed on the second segment, the first segment and the second segment are mounted in a squeezing bracket, the driving shaft is formed integrally extending outward from an end of the third segment, and the elastic soft body is disposed around the perimeter of the third segment.

2. The squeezer according to claim 1, wherein the pair of rolling shafts are rotatable in opposite directions and provided with a rolling shaft squeezing segment and a rolling shaft locking portion, wherein the rolling shaft locking portion is used to operatively lock or loosen the pair of rolling shafts, and the pair of rolling shafts are arranged to operatively clamp a liner bag between the rolling shaft squeezing segments, wherein after the liner bag is located between the rolling shaft squeezing segments of the pair of rolling shafts, and the pair of rolling shafts are locked by the rolling shaft locking portions, the opposite rotation of the rolling shaft squeezing segments of the pair of rolling shafts will apply a squeezing force to the liner bag.

3. The squeezer according to claim 1, wherein the outer diameter of at least one portion of the elastic soft body uniformly varies in the axial direction to form a tapered elastic soft body.

4. The squeezer according to claim 1, wherein the driving device further includes a gearbox and an assembling base, wherein the motor is connected with the gearbox, the assembling base is disposed on a side of the gearbox and is provided with a driving member therein, and the driving member is provided with a driving hole, the driving shaft is provided on an end of the supporting rod for cooperation with the driving hole, wherein one end of the squeezing bracket is accommodated in the assembling base, and the driving shaft of the rolling shaft is accommodated in the driving hole.

5. A fluid discharge system comprising a container and a liner bag which is installed in the container and provided with a discharge port, wherein the fluid discharge system further includes a pair of squeezing members and a driving device, the driving device including a motor, wherein the pair of squeezing members are configured to operatively clamp the liner bag therebetween and apply a squeezing force to the liner bag while the pair of squeezing members and the liner bag are relatively moving; and the driving device is associated with the pair of squeezing members and at least capable of driving at least one of the pair of squeezing members to move relative to the other, wherein the liner bag is used to contain liquid, the pair of squeezing members are further configured to be capable of applying a preclamping force to the liner bag when the liner bag is clamped by the squeezer, the pair of squeezing members and the driving device are configured to be able to descend automatically as the liquid in the liner bag decreases, wherein the pair of squeezing members and the driving device are configured to move freely along the liner bag with respect to the container, the pair of squeezing members are a pair of rolling shafts, each of the rolling shafts includes a supporting rod and an elastic soft body, the elastic soft body is disposed around the supporting rod, the squeezer comprises a squeezing device and the driving device, wherein the squeezing device is composed of a first part and a second part, each of the first part and the second part including one of the pair of rolling shafts, a squeezing bracket and a gear, the two ends of the rolling shafts are respectively installed in two squeezing brackets, and at least one end of the rolling shaft is provided with a gear, which is mounted around a portion of the rolling shaft that is located in the squeezing bracket, and the first part and the second part clamp the liner bag and are fixed by cooperation of the squeezing brackets at two ends of each rolling shaft, the supporting rod includes a first segment, a second segment, a third segment and a driving shaft, the outer diameter of the first segment is less than that of the second segment, the outer diameter of the second segment is less than that of the third segment, wherein the gear is installed on the second segment, the first segment and the second segment are mounted in the squeezing bracket, the driving shaft is formed by integrally extending outward from an end of the third segment, and the elastic soft body is disposed around the perimeter of the third segment.

6. The fluid discharge system according to claim 5, wherein the pair of rolling shafts are rotatable in opposite directions and provided with a rolling shaft squeezing segment and a rolling shaft locking portion, wherein the rolling shaft locking portion is used to operatively lock or loose the pair of rolling shafts, and the pair of rolling shafts are arranged to operatively clamp the liner bag between the rolling shaft squeezing segments, wherein after the liner bag is located between the rolling shaft squeezing segments of the pair of rolling shafts and the pair of rolling shafts are locked by the rolling shaft locking portions, the opposite rotation of the rolling shaft squeezing segments of the pair of rolling shafts will apply a squeezing force to the liner bag.

7. The fluid discharge system according to claim 5, wherein each of the rolling shafts includes a supporting rod and an elastic soft body, the elastic soft body is disposed around the supporting rod, and an outer diameter of at least one portion of the elastic soft body uniformly varies in the axial direction to form a tapered elastic soft body.

8. The fluid discharge system according to claim 5, wherein the liner bag is formed by hermetically welding a front panel and a rear panel, and the distance between the lower edge of the discharge port and the weld line of the bottom of the liner bag is less than or equal to 15 cm.

9. The fluid discharge system according to claim 5, wherein the driving device further includes a gearbox and an assembling base, wherein the motor is connected with the gearbox, the assembling base is disposed on a side of the gearbox and is provided with a driving member therein, and the driving member is provided with a driving hole, the driving shaft is provided on an end of the supporting rod for cooperation with the driving hole, wherein one end of the squeezing bracket is accommodated in the assembling base, and the driving shaft of the rolling shaft is accommodated in the driving hole.

* * * * *